US010675873B2

(12) United States Patent
Akita et al.

(10) Patent No.: US 10,675,873 B2
(45) Date of Patent: Jun. 9, 2020

(54) HEAD CLEANING DEVICE, IMAGE FORMING DEVICE, AND HEAD CLEANING METHOD OF IMAGE FORMING DEVICE

(71) Applicant: Konica Minolta, Inc., Tokyo (JP)

(72) Inventors: Hiroshi Akita, Kokubunji (JP); Taku Mitsuhashi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/426,166

(22) Filed: May 30, 2019

(65) Prior Publication Data

US 2020/0009870 A1 Jan. 9, 2020

(30) Foreign Application Priority Data

Jul. 5, 2018 (JP) ..... 2018-128075

(51) Int. Cl.
*B41J 2/165* (2006.01)

(52) U.S. Cl.
CPC ..... *B41J 2/16535* (2013.01); *B41J 2/16552* (2013.01)

(58) Field of Classification Search
CPC ..... B41J 2/16535; B41J 2/16552
See application file for complete search history.

(56) References Cited

U.S. PATENT DOCUMENTS 6,460,967 B1 * 10/2002 Makita ..... B41J 2/1652 347/33
2008/0218550 A1 * 9/2008 Tsuji ..... B41J 2/175 347/19
2010/0214356 A1 * 8/2010 Maida ..... B41J 2/16552 347/28

FOREIGN PATENT DOCUMENTS

JP 2012179811 A 9/2012

* cited by examiner

*Primary Examiner* — Jason S Uhlenhake
(74) *Attorney, Agent, or Firm* — Lucas & Mercanti, LLP

(57) ABSTRACT

A head cleaning device includes: a porous cleaning roller that rotates around a cylindrical axis while a cylindrical side circumferential surface is in pressure contact with a nozzle surface of an ink head to clean the nozzle surface; a storage tank that immerses a lower part of the cleaning roller in a cleaning liquid stored therein; a unit moving mechanism that moves a cleaning unit including the storage tank and the cleaning roller in a direction perpendicular to the axis of the cleaning roller; a hardware processor that controls a rotation speed [vr] of the cleaning roller and a moving speed [vx] of the storage tank and the cleaning unit; and a composition acquisition part that acquires a change in composition of the cleaning liquid in the storage tank due to mixing of ink supplied from the nozzle surface through the cleaning roller.

12 Claims, 11 Drawing Sheets

HEAD CLEANING DEVICE, IMAGE FORMING DEVICE, AND HEAD CLEANING METHOD OF IMAGE FORMING DEVICE

The entire disclosure of Japanese patent Application No. 2018-128075, filed on Jul. 5, 2018, is incorporated herein by reference in its entirety.

BACKGROUND

Technological Field

The present invention relates to a head cleaning device, an image forming device, and a head cleaning method of the image forming device.

Description of the Related Art

An inkjet type image forming device includes a head cleaning device for cleaning a nozzle surface on which a nozzle opening of an ink head is arranged. As the head cleaning device, there are devices provided with a conductive cleaning roller and devices provided with a porous cleaning roller for impregnating a cleaning liquid. These cleaning rollers rotate in a state in which the outer circumferential surface faces a nozzle surface, and move along the nozzle surface in a further rotated state, and have a configuration in which ink or bubble attached to the nozzle opening and the nozzle surface is moved to the outer circumferential surface side of the cleaning roller, and removed.

Among these, regarding the head cleaning device provided with a conductive cleaning roller (roller for cleaning), JP 2012-179811 A discloses that a clearance between each ink discharge head and a cleaning roller (or a cleaning belt) at the time of cleaning of each ink discharge head, and a relative speed of each ink discharge head and an outer circumferential surface of the cleaning roller (or a surface of the cleaning belt) can be adjusted according to the characteristics of an ink used for recording, that is, the surface tension, viscosity or the like of the ink, so that the cleaning efficiency of each ink discharge head can be further improved regardless of the characteristics of the ink used for recording.

On the other hand, a head cleaning device provided with a porous cleaning roller is used in a state in which a lower part of a cleaning roller is immersed in a cleaning liquid. In such a porous cleaning roller, the ink moved to the outer circumferential surface side of the cleaning roller is absorbed together with the cleaning liquid into a hole formed on the outer circumferential surface side of the cleaning roller. The ink absorbed in the hole of the cleaning roller is replaced with the cleaning liquid stored in a storage tank in the storage tank.

For this reason, in the head cleaning device provided with the porous cleaning roller, the density of the ink relative to the cleaning liquid in the storage tank gradually increases with the increase in the number of cleaning of the ink head so that the surface tension of the cleaning liquid changes. Therefore, as the number of cleaning of the ink head increases, the surface tension of the cleaning liquid supplied to the nozzle surface in the state of being impregnated in the cleaning roller changes. Such a change in the surface tension of the cleaning liquid affects the wiping performance of the nozzle surface by the surface of the cleaning roller, which causes the generation of the remaining ink and the cleaning liquid containing the ink on the nozzle surface.

SUMMARY

Therefore, the present invention has an object to provide a head cleaning device capable of stably maintaining wiping performance of a nozzle surface by a porous cleaning roller impregnating a cleaning liquid, an image forming device provided with the head cleaning device, and a head cleaning method of the image forming device.

To achieve the abovementioned object, according to an aspect of the present invention, a head cleaning device reflecting one aspect of the present invention comprises a porous cleaning roller that is arranged with a cylindrical axis kept horizontal, rotates around the axis while a cylindrical side circumferential surface is in pressure contact with a nozzle surface of an ink head to clean the nozzle surface; a storage tank that is provided to store a cleaning liquid and immerse a lower part of the cleaning roller in the cleaning liquid stored; a unit moving mechanism that moves a cleaning unit including the storage tank and the cleaning roller in a direction perpendicular to the axis of the cleaning roller; a hardware processor that controls a rotation speed [vr] of the cleaning roller and a moving speed [vx] of the storage tank and the cleaning unit; and a composition acquisition part that acquires a change in composition of the cleaning liquid in the storage tank due to mixing of ink supplied from the nozzle surface through the cleaning roller, wherein the hardware processor controls a speed ratio [vr/vx] of the rotation speed [vr] to the moving speed [vx] based on a change in the composition of the cleaning liquid acquired by the composition acquisition part.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Formation of implementation of a head cleaning device to which the present invention is applied, an image forming device provided with the head cleaning device, and an ink head cleaning method in the image forming device will be described below.

First Embodiment (Image Forming Device)

Figure 1:
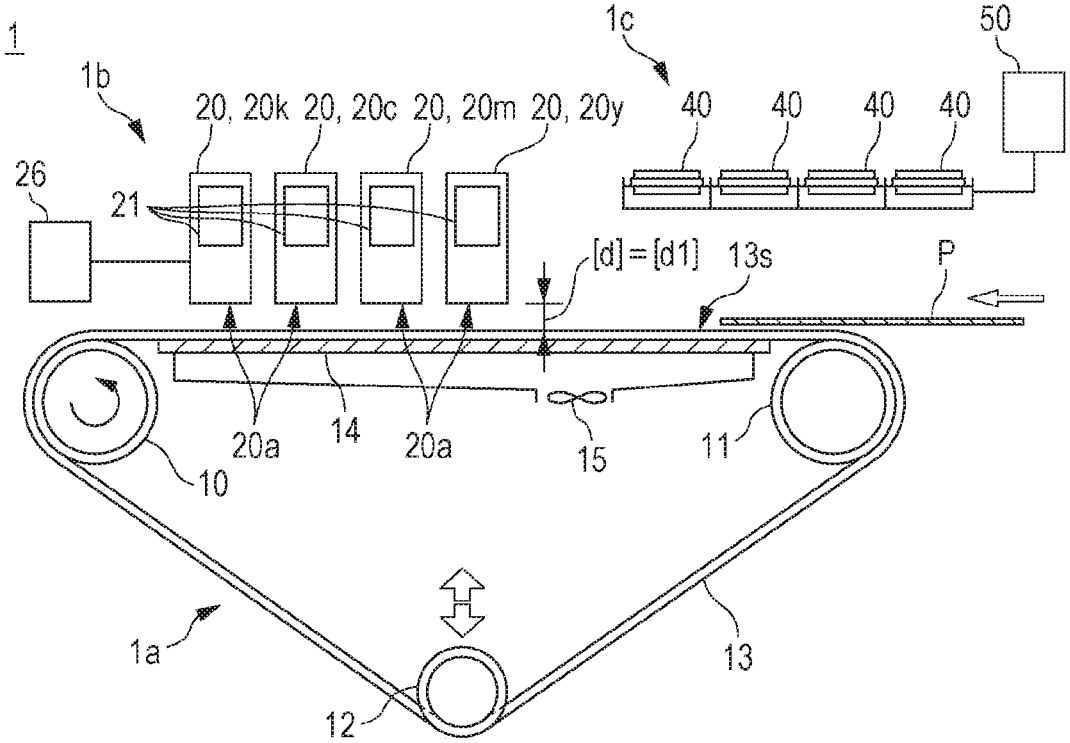
FIG. 1 is a main part configuration diagram (part 1) of an image forming device according to a first embodiment.
Figure 2:
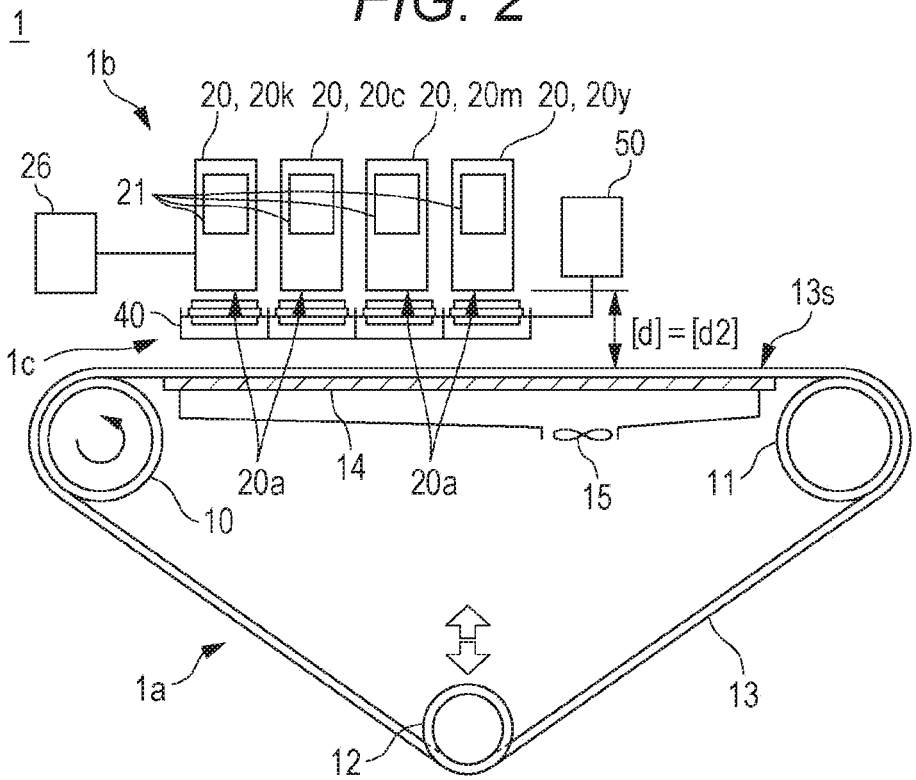
FIG. 2 is a main part configuration diagram (part 2) of the image forming device according to the first embodiment.

FIG. 1 is a main part configuration diagram (part 1) of an image forming device 1 according to a first embodiment, and FIG. 2 is a main part configuration diagram (part 2) of the image forming device 1 according to the first embodiment. These drawings are the side views of an image formation part in the image forming device 1 of an inkjet type. As shown in these drawings, the image forming device 1 of the inkjet type according to the first embodiment includes a belt conveyance device 1*a*, an ink supply device 1*b*, and a head cleaning device 1*c*. These are formed as follows.

<Belt Conveyance Device 1*a*>

The belt conveyance device 1*a* is for conveying a recording medium P in a predetermined direction. The belt conveyance device 1*a* includes a drive roller 10, a driven roller 11, a tension control roller 12, and an endless belt 13 stretched around them, and makes the endless belt 13 circle around by the rotation of the drive roller 10. The endless belt 13 has a plurality of through holes, and an outer circumferential surface portion between the drive roller 10 and the driven roller 11 is a mounting surface 13*s* of the recording medium P.

The belt conveyance device 1*a* further includes a support 14 that supports the endless belt 13 from an inner circumferential side, and a suction fan 15. The support 14 is a plate-like member for supporting the endless belt 13 from the inner circumferential side between the drive roller 10 and the driven roller 11, and has a plurality of through holes communicating with the through holes of the endless belt 13. The suction fan 15 sucks the air on the mounting surface 13*s* side of the endless belt 13 through the through holes of the support 14 and the through holes of the endless belt 13, and causes the recording medium P supplied on the mounting surface 13*s* to be adsorbed to the mounting surface 13*s*. As a result, the belt conveyance device 1*a* is formed to convey the recording medium P in a state of being adsorbed to the mounting surface 13*s* in the circling direction of the endless belt 13.

<Ink Supply Device 1*b*>

The ink supply device 1*b* is for supplying ink to the recording medium P conveyed by the belt conveyance device 1*a*. The ink supply device 1*b* has a plurality of head units 20 for supplying ink of each color. Each head unit 20 is provided with an ink head control part 21 for controlling the supply of ink.

Each head unit 20 is arranged along the conveyance direction of the recording medium P by the belt conveyance device 1*a* in a state where a nozzle surface 20*a* described below faces the mounting surface 13*s* of the belt conveyance device 1*a*. As an example, FIGS. 1 and 2 show a configuration in which a yellow head unit 20*y*, a magenta head unit 20*m*, a cyan head unit 20*c*, and a black head unit 20*k* are arranged in order along a conveyance direction of the recording medium P. However, the arrangement order of the head units 20 is not limited to this order.

Figure 3:
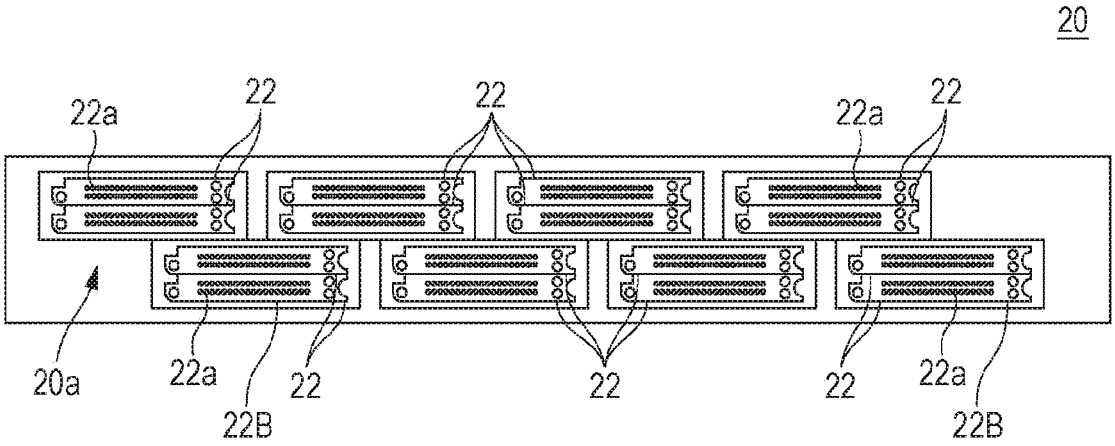
FIG. 3 is a bottom view of a head unit provided in the image forming device according to the first embodiment.

FIG. 3 is a bottom view of the head unit 20 provided in the image forming device according to the first embodiment, and is a view of one of the head units 20 shown in FIGS. 1 and 2 viewed from the nozzle surface 20*a* side directed to the belt conveyance device 1*a*. As shown in FIG. 3, the head unit 20 has a plurality of ink heads 22 arrayed along the nozzle surface 20*a* directed to the belt conveyance device 1*a* side. In the illustrated example, a pair of ink heads 22 is used as one set, and a plurality of sets (here, eight sets) of ink heads 22 are arranged in two rows in a zigzag.

The nozzle surface 20*a* of each head unit 20 is a water repellent surface, and is arranged with a nozzle opening 22*a* that is one opening of the nozzle formed in the ink head 22. The ink head 22 of each head unit 20 discharges ink from the nozzle openings 22*a* on the basis of an instruction from the ink head control part 21 (see FIGS. 1 and 2).

Each ink head 22 performs pressure purge on the basis of an instruction from the ink head control part 21 (see FIGS. 1 and 2). Here, the pressure purge is processing performed to prevent clogging of the ink at the nozzle that has not discharged ink for a predetermined period, and in which the ink in the nozzle is forcibly pushed out by blowing air into the nozzle. Such pressure purge is selectively performed for each ink head 22.

Figure 4:
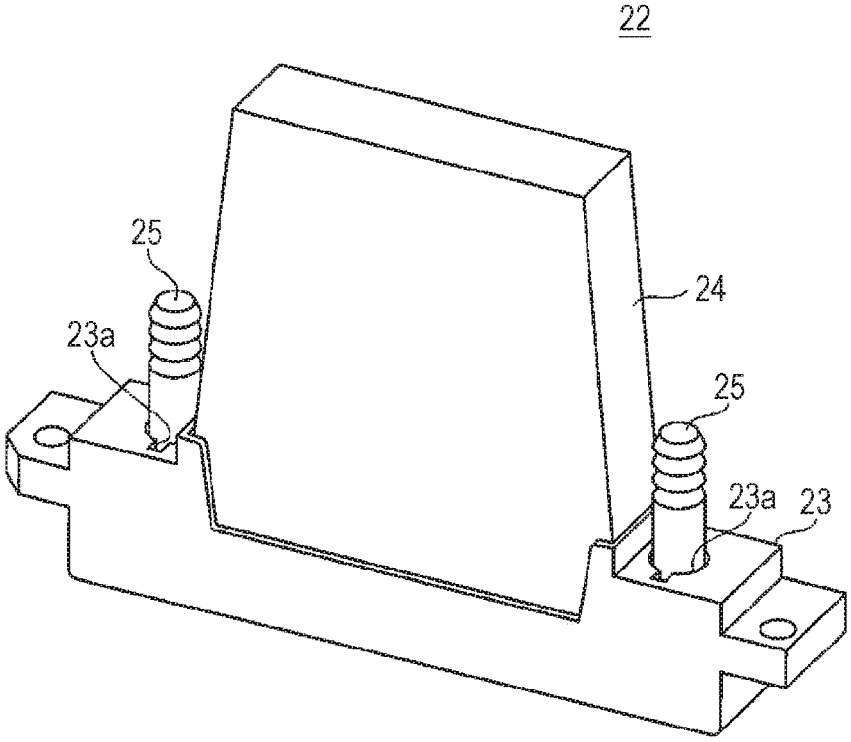
FIG. 4 is a perspective view of an ink head according to the first embodiment.

FIG. 4 is a perspective view of the ink head 22 according to the first embodiment. As shown in this drawing, each ink head 22 accommodates the main part of the ink head 22 inside an exterior material formed of a cover member 23 and a housing 24 fitted with the cover member 23.

Among these, the cover member 23 accommodates a head chip in which a plurality of nozzles for discharging ink is formed, and holds the nozzle opening 22*a* (see FIG. 3) at the tip of the nozzle in a state of being exposed to the outside. The cover member 23 accommodates a manifold for storing ink in a state of being communicated with each nozzle formed in the head chip. The cover member 23 as described above is provided with a takeout hole 23*a* through which a connector 25 for supplying ink into the manifold projects. The housing 24 accommodates a flexible printed board on which the ink head control part 21 (see FIGS. 1 and 2) for controlling the discharge of ink from the nozzle opening 22*a* (see FIG. 3) is formed.

Referring back to FIGS. 1 and 2, the ink supply device 1*b* as described above includes a height adjustment mechanism 26 for adjusting the height position of each head unit 20. As a result, the height position of the belt conveyance device 1*a* relative to the mounting surface 13*s* can be adjusted freely, and the interval [d] between the nozzle surface 20*a* of each head unit 20 and the mounting surface 13*s* of the endless belt 13 can be freely changed. Here, the interval [d]=[d1] shown in FIG. 1 is an interval at the time of image formation, and is an interval [d1] when an image is formed on the recording medium P by the ink supply from the ink supply device 1*b*. On the other hand, the interval [d]=[d2] shown in FIG. 2 is an interval at the time of head cleaning, and is an interval [d2] when the nozzle surface 20*a* of each head unit 20 is cleaned. The interval [d2] is such a size that the cleaning unit 40 of the head cleaning device 1*c* described below is arranged at the interval [d2].

<Head Cleaning Device 1*c*>

The head cleaning device 1*c* is for cleaning the nozzle surface 20*a* of each head unit 20. The head cleaning device 1*c* has a plurality of cleaning units 40 corresponding to each head unit 20 and a cleaning control part 50. These are formed as follows.

—Cleaning Unit 40—

Each cleaning unit 40 is located at a sheltered position away from each head unit 20 at the time of image formation shown in FIG. 1. On the other hand, at the time of head cleaning shown in FIG. 2, each cleaning unit 40 is located between the nozzle surface 20*a* of each head unit 20 and the mounting surface 13*s* of the endless belt 13.

Figure 5:
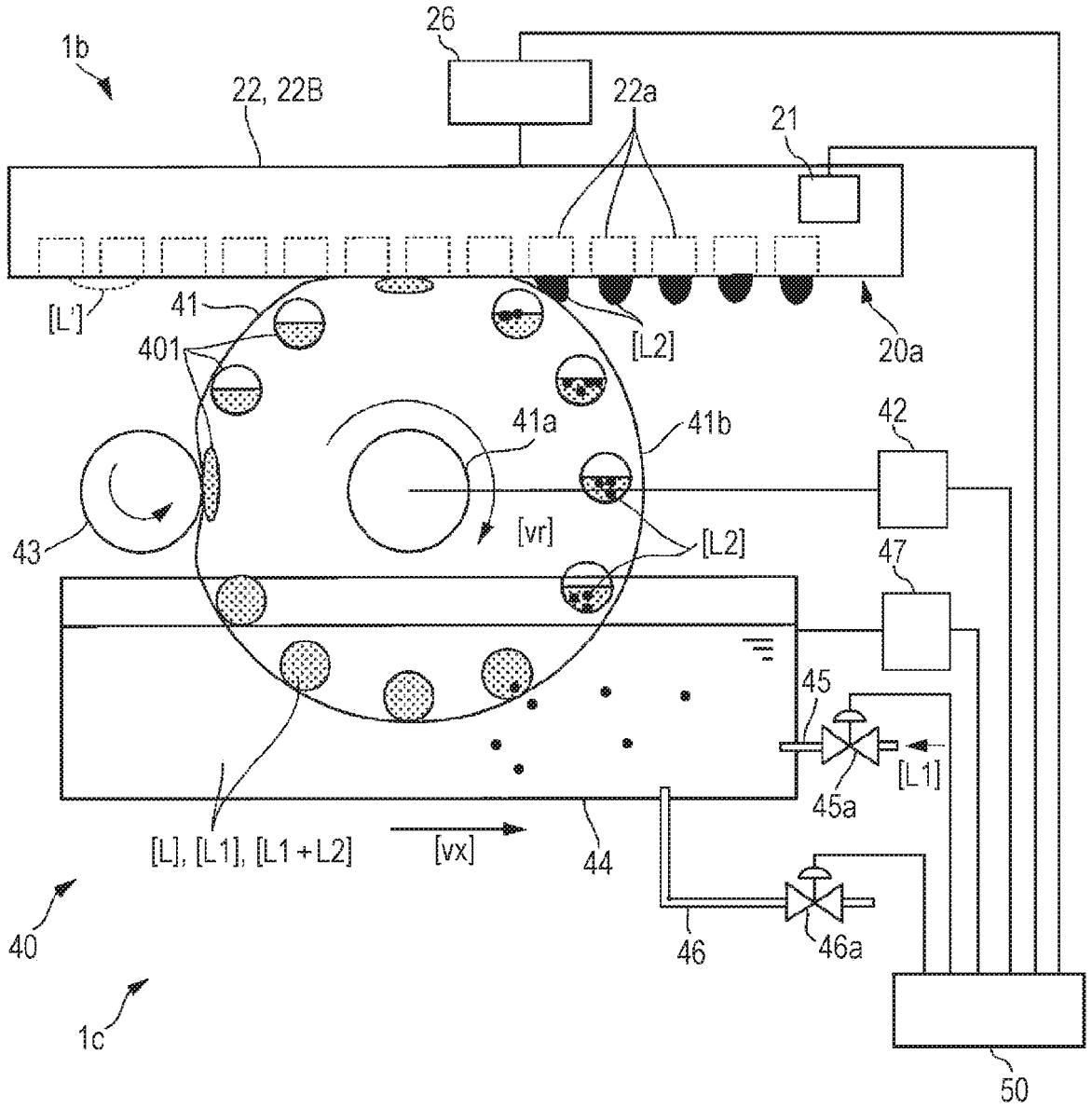
FIG. 5 is a configuration diagram of a head cleaning device according to the first embodiment.

FIG. 5 is a configuration diagram of the head cleaning device 1*c* according to the first embodiment, and is a view representatively showing one of the cleaning units 40 shown in FIGS. 1 and 2. FIG. 5 shows the state of the cleaning unit 40 at the time of head cleaning (see FIG. 2) when the ink supply device 1*b* performs the pressure purge, together with the ink head 22B subjected to the pressure purge.

As shown in this drawing, each cleaning unit 40 provided in the head cleaning device 1*c* includes a cleaning roller 41, a roller drive part 42, a throttle member 43, a storage tank 44, a supply pipe 45, a drain pipe 46, and a unit moving mechanism 47. These members are formed as follows.

[Cleaning Roller 41]

The cleaning roller 41 has a cylindrical wiping member 41*b* coaxially mounted on a roller shaft 41*a*. The roller shaft 41*a* is rotatably supported by a support means (not shown). The roller shaft 41*a* as described above is preferably made of a material that is high in rigidity and difficult to rust, and is made of, for example, stainless steel. On the other hand, the wiping member 41*b* is made of a porous material having elasticity, and is used by impregnating a porous hole portion 401 with the cleaning liquid [L]. The cleaning liquid [L] to be impregnated into the hole portion 401 of the cleaning roller 41 is a liquid stored in the storage tank 44 described below. It is preferable that the wiping member 41*b* as described above be formed to be attachable to and removable from the roller shaft 41*a* in order to facilitate replacement when the wiping member 41*b* is exhausted.

The cleaning roller 41 forms a nip portion in which the side circumferential surface formed by the wiping member 41*b* is brought into pressure contact with the nozzle surface 20*a* of the ink supply device 1*b* during head cleaning, and is positioned and arranged in the vertical direction such that the nip amount of the nip portion is within a range of appropriate values. The cleaning roller 41 is arranged in a state in which the lower part is immersed in the cleaning liquid [L] stored in the storage tank 44 described below at the time of head cleaning. In this state, when the cleaning roller 41 rotates, the wiping member 41*b* impregnated with the cleaning liquid [L] in the storage tank 44 slides against the nozzle surface 20*a* of the ink supply device 1*b*, and wipes off the ink [L2] of the nozzle surface 20*a* and the nozzle opening 22*a* located on the nozzle surface 20*a*. The ink [L2] of each nozzle opening 22*a* is the ink [L2] forcibly discharged from the nozzle opening 22*a* by the pressure purge.

Here, the coefficient of thermal expansion of the wiping member 41*b* in the state impregnated with the cleaning liquid [L] is set so as to be ±0.5 mm or less centering on the nip amount at room temperature (25° C.). As a result, it is possible to perform preferable cleaning regardless of the environmental temperature. Specifically, the nip amount is preferably in the range of 0.85 to 1.85 mm (1.35±0.5 mm).

It is preferable that the expansion of the outer diameter of the wiping member 41*b* due to the impregnation of the cleaning liquid [L] at 25° C. be 0.5 mm or less, since the wiping member 41*b* can perform preferable cleaning regardless of the impregnation rate of the cleaning liquid [L]. As a result, regardless of the impregnation rate of the cleaning liquid [L] in the wiping member 41*b*, the outer diameter of the wiping member 41*b* can be within the range of the nip amount (1.35±0.5 mm), and preferable cleaning can be performed.

It is preferable that an average porosity be 70% or more and an average pore diameter measured by a porosimeter be 700 μm or less, since the wiping member 41*b* can perform preferable cleaning Here, the average porosity can be determined by determining the sample volume (true volume) from the gas law of the pressure change boiler by one of gas replacement methods, and using the ratio between the sample volume and the apparent volume of this sample. The average pore diameter can also be determined by adopting an average value of several (five to ten pieces, different depending on the sample) in descending order of the pores confirmed in the electron micrograph of the sample, the average value measured with a measure printed on the electron micrograph.

The wiping member 41*b* having the above-described characteristics is made of, for example, a porous material having open cells made of a plastic polymer or the like. Particularly, as the material of the wiping member 41*b* which satisfies the above conditions, in particular, polyurethane is preferable. Specifically, for example, when Lubilar L31 (trade name, Toyo Polymer Co., Ltd.) is used as the material, particularly preferable cleaning effect can be obtained. Since the said material can be processed and preserved in a dry state, it is suitable as the wiping member 41*b* also at the point that it is easy to be stored and handled.

The outer diameter of the wiping member 41*b* can be appropriately selected in accordance with the size of the head unit 20, but it is preferable to set the outer diameter to 20 to 50 mm in order to perform preferable cleaning. This is because, if the outer diameter of the wiping member 41*b* is set to 20 mm or more, after the wiping member 41*b* is pressed with the throttle member 43 described later, it becomes easy to secure time for the wiping member 41*b* to be restored before wiping the nozzle surface 20*a*, while, if the outer diameter of the wiping member 41*b* is 50 mm or less, manufacture is facilitated.

[Roller Drive Part 42]

The roller drive part 42 is a part that rotates the cleaning roller 41 described above, and includes, for example, a motor. The roller drive part 42 rotates the cleaning roller 41 at a rotation speed [vr] instructed by the cleaning control part 50 described below.

[Throttle Member 43]

The throttle member 43 is provided in a state of being in pressure contact with the side circumferential surface of the cleaning roller 41 constituted by the wiping member 41*b*, and controls the amount of the cleaning liquid [L] impregnated in the wiping member 41*b*. The throttle member 43 as described above is made of a material harder than the wiping member 41*b*, such as hard rubber or stainless steel, and for example, is a roller shape having the length with which the throttle member 43 can press the side circumferential surface of the cleaning roller 41 in the entire width direction of the cleaning roller 41. The roller-shaped throttle member 43 is rotatably supported by a support member (not shown), and rotates following the rotation of the cleaning roller 41, and the pressing force on the cleaning roller 41 can be adjusted.

The throttle member 43 as described above is located downstream of the liquid surface of the cleaning liquid [L] in the storage tank 44 in the rotation direction of the cleaning roller 41, and upstream of the nip portion between the cleaning roller 41 and the nozzle surface 20*a* of the head unit 20. As a result, after the wiping member 41*b* of the cleaning roller 41 impregnates the cleaning liquid [L], the throttle member 43 is formed to press the wiping member 41*b* in the radial direction before wiping the nozzle surface 20*a* of the head unit 20, and adjust the amount of impregnation of the cleaning liquid [L] in the wiping member 41*b* to an appropriate amount.

The amount of biting of the throttle member 43 into the wiping member 41*b* is preferably 0.5 mm or more and 60% or less of the thickness of the wiping member 41*b*, and is particularly preferably adjusted within a range of 0.5 mm or more and 50% or less of the thickness of the wiping member 41*b* in view of optimizing the throttling amount of the cleaning liquid [L]. As described above, since the cleaning liquid [L] impregnated in the wiping member 41*b* can be adjusted to an appropriate amount by the throttle member 43, the dispersion of the impregnation ratio of the cleaning liquid in the wiping member 41*b* is suppressed, and the dispersion of the expansion of the outer diameter due to the impregnation of the cleaning liquid can also be suppressed.

Although the example using the roller-shaped throttle member 43 is described above as a method of adjusting the amount of impregnation of the cleaning liquid [L] in the wiping member 41*b*, it can be changed as appropriate as long as it is a method capable of adjusting the amount of impregnation, and, for example, a spatula-shaped throttle plate may be used as the throttle member 43.

By appropriately selecting the material, porosity, pore diameter, and the like of the wiping member 41*b*, and by appropriately setting the rotation speed [vr] of the cleaning roller 41, even in the absence of the throttle member 43, the amount of impregnation of the cleaning liquid [L] in the wiping member 41*b* can be made appropriate, and in this case, the throttle member 43 can be omitted.

[Storage Tank 44]

The storage tank 44 is for storing the cleaning liquid [L] and impregnating the wiping member 41*b* of the cleaning roller 41 with the cleaning liquid [L] by immersing the lower part of the cleaning roller 41 in the stored cleaning liquid [L]. The storage tank 44 as described above may be, for example, a single tank type or a two tank type.

The cleaning liquid [L] stored in the storage tank 44 is a cleaning liquid [L1] in the initial state supplied from the supply pipe 45 described below, or the cleaning liquid [L1] in the initial state mixed with ink [L2] supplied from the hole portion 401 of the cleaning roller 41. As the cleaning liquid [L1] in the initial state supplied from the supply pipe 45, for example, pure water or the like is used. A surfactant or the like may be appropriately added to the cleaning liquid [L1] in the initial state in order to enhance the detergency, and the liquid is preferably a liquid that does not occur aggregation even when mixed with the ink [L2], and does not significantly change the characteristics such as viscosity and surface tension of the ink [L2]. Specifically, an ink liquid from which a dye or a pigment is removed is suitable. It is preferable to put a preservative or the like in view of long-term storage of the cleaning liquid [L]. It is preferable to add an antifoaming agent since bubbles are less likely to be generated in the cleaning liquid [L] at the time of cleaning.

[Supply Pipe 45]

The supply pipe 45 is a pipe for supplying the cleaning liquid [L1] to the storage tank 44. The supply pipe 45 is provided with an on-off valve 45*a*, and can freely supply the cleaning liquid [L1] from the cleaning liquid storage part (not shown) into the storage tank 44 via the supply pipe 45 by driving of the on-off valve 45*a*. The on-off valve 45*a* as described above is a motor-operated valve that can freely open and close the supply pipe 45 according to an instruction from the cleaning control part 50 described below, and is, for example, a solenoid valve or a motor-operated valve.

[Drain Pipe 46]

The drain pipe 46 is a pipe for discharging the cleaning liquid [L] from the storage tank 44. The drain pipe 46 is provided with an on-off valve 46*a*, and can freely discharge the cleaning liquid [L] from the inside of the storage tank 44 to the waste liquid storage part (not shown) via the drain pipe 46 by driving of the on-off valve 46*a*. The on-off valve 46*a* as described above is a motor-operated valve that can freely open and close the drain pipe 46 according to an instruction from the cleaning control part 50 described below, and is, for example, a solenoid valve or a motor-operated valve.

[Unit Moving Mechanism 47]

The unit moving mechanism 47 is a mechanism for moving each cleaning unit 40. At the time of image formation (see FIG. 1), the unit moving mechanism 47 retracts the cleaning unit 40 to a retraction place apart from each head unit 20. On the other hand, at the time of head cleaning (see FIG. 2), each cleaning unit 40 is located between the nozzle surface 20*a* of each head unit 20 and the mounting surface 13*s* of the endless belt 13 in a predetermined state of each cleaning unit 40. In this case, as described above, the unit moving mechanism 47 adjusts the height of each cleaning unit 40 such that the side circumferential surface formed by the wiping member 41*b* of the cleaning roller 41 is brought into pressure contact with the nozzle surface 20*a* of each head unit 20 by a predetermined nip amount.

Figure 6:
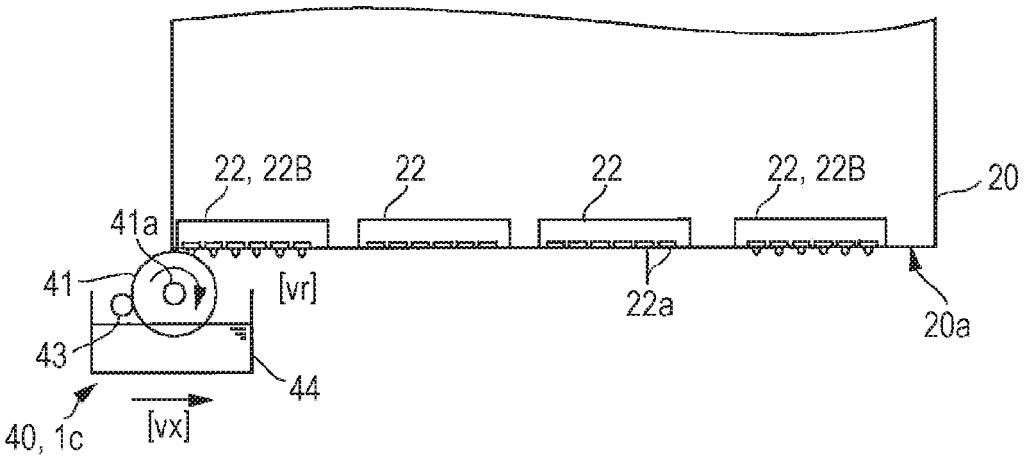
FIG. 6 is a diagram (part 1) explaining cleaning of a nozzle surface by the head cleaning device according to the first embodiment.
Figure 7:
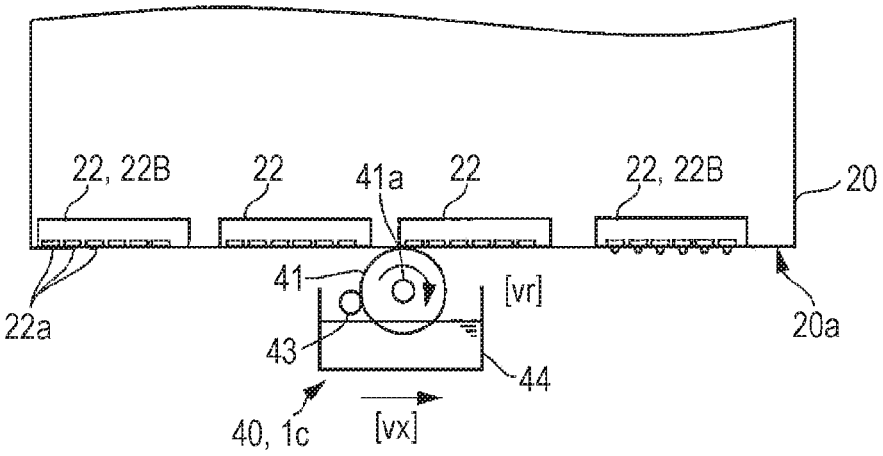
FIG. 7 is a diagram (part 2) explaining the cleaning of the nozzle surface by the head cleaning device according to the first embodiment.
Figure 8:
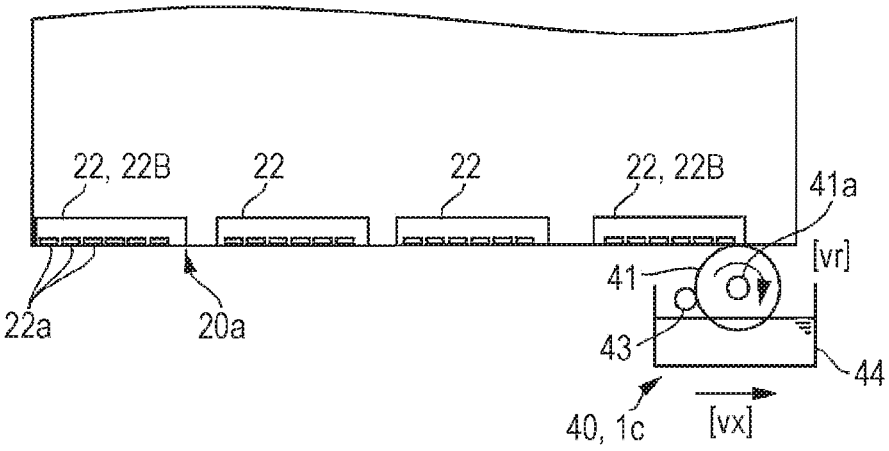
FIG. 8 is a diagram (part 3) explaining the cleaning of the nozzle surface by the head cleaning device according to the first embodiment.

Here, FIGS. 6 to 8 show (part 1) to (part 3) explaining the cleaning of the nozzle surface 20*a* by the head cleaning device 1*c* according to the first embodiment. These drawings correspond to a view of the pair of head unit 20 and the cleaning unit 40 at the time of head cleaning as viewed from the axial direction of the cleaning roller 41.

As shown in these drawings, the unit moving mechanism 47 moves the cleaning roller 41 relative to the nozzle surface 20*a* of each head unit 20 at a predetermined moving speed [vx] at the time of head cleaning.

Here, the cleaning roller 41 is arranged in a state where the roller shaft 41*a* is directed perpendicularly to the extending direction of the nozzle surface 20*a*. The unit moving mechanism 47 moves the cleaning roller 41 arranged in this manner in one of the directions perpendicular to the roller shaft 41*a* of the cleaning roller 41 and parallel to the nozzle surface 20*a*. It is preferable that the moving direction of the cleaning roller 41 be the same as the rotation direction of the cleaning roller 41 in the nip portion between the nozzle surface 20*a* and the cleaning roller 41.

The unit moving mechanism 47 moves the throttle member 43 and the storage tank 44 together with the cleaning roller 41 at the moving speed [vx] while maintaining the positional relationship with the cleaning roller 41. It is assumed that the movement of each cleaning unit 40 by the unit moving mechanism 47 at the time of the head cleaning is individually implemented for each cleaning unit 40.

—Cleaning Control Part 50—

Figure 9:
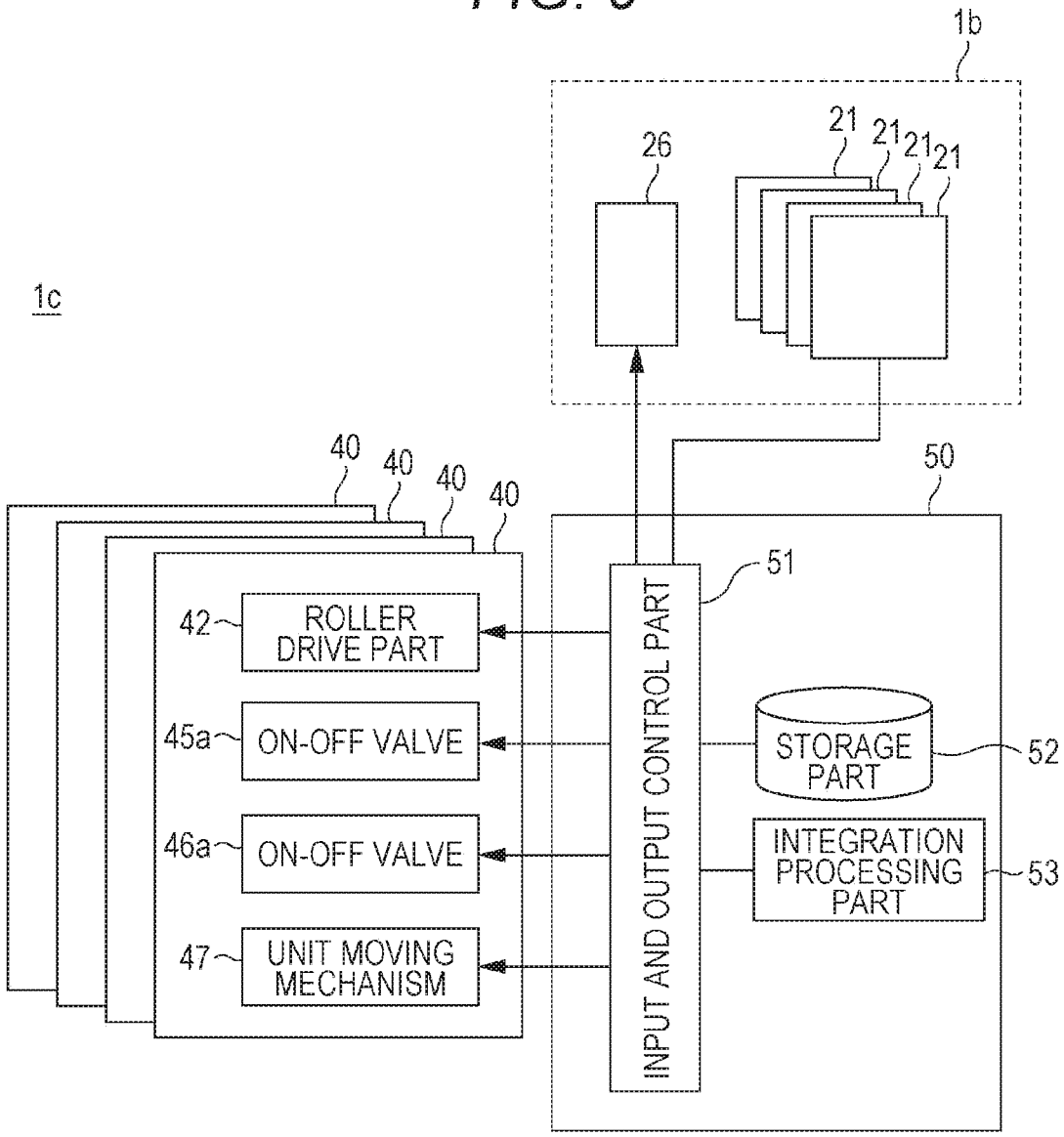
FIG. 9 is a block diagram of the head cleaning device according to the first embodiment.

FIG. 9 is a block diagram of the head cleaning device 1*c* according to the first embodiment and is a view mainly explaining the configuration of the cleaning control part 50. The cleaning control part 50 controls the operation of each part of the cleaning unit 40, and is formed by a computer such as a microcomputer. The computer includes a central processing unit (CPU), a read only memory (ROM), and a random access memory (RAM).

The cleaning control part 50 as described above includes an input and output control part 51, a storage part 52, and an integration processing part 53. Each of these parts has a function to be described next, and the CPU in the cleaning control part 50 reads out and executes a program stored in the ROM to realize each function. Hereinafter, the details of each part constituting the cleaning control part 50 will be described on the basis of FIG. 9 and FIG. 5 described above.

[Input and Output Control Part 51]

The input and output control part 51 is connected to the roller drive part 42, the on-off valves 45*a*, 46*a*, and the unit moving mechanism 47 of each cleaning unit 40, and further connects the storage part 52 and the integration processing part 53 to each other. The input and output control part 51 is connected to the ink head control part 21 and the height adjustment mechanism 26 of the ink supply device 1*b*.

The input and output control part 51 as described above performs input and output processing of data between the respective parts connected to each other via the input and output control part 51, performs determination processing, and controls the drive of the roller drive part 42, the on-off valves 45*a*, 46*a*, and the unit moving mechanism 47 and the drive of the height adjustment mechanism 26 of the ink supply device 1*b*. As a result, the cleaning processing of the nozzle surface 20*a* by the cleaning unit 40 is performed. The cleaning processing of the nozzle surface 20*a* performed by the input and output control part 51 will be described in detail in the following head cleaning method.

[Storage Part 52]

The storage part 52 stores various pieces of data for implementing the head cleaning method by the head cleaning device 1*c*. Such data are, for example, the history of head cleaning processing and speed setting data.

Among the pieces of data, the speed setting data is data for setting and adjusting the moving speed [vx] of each cleaning unit 40 and the rotation speed [vr] of each cleaning roller 41. The rotation speed [vr] is the surface speed of the side circumferential surface of the cleaning roller 41. The storage part 52 corresponds to data representing a change in the composition of the cleaning liquid [L] in the storage tank 44 as speed setting data, and stores the moving speed [vx] of the cleaning unit 40 and the rotation speed [vr] of the cleaning roller 41. Here, the change in the composition of the cleaning liquid [L] is the change in the density of the ink [L2] in the cleaning liquid [L]. Such speed setting data is unique data for each combination of the cleaning liquid [L1] and the ink [L2] supplied from the supply pipe 45, and is stored in the storage part 52 for each combination of the cleaning liquid [L1] and the ink [L2].

Tables 1 and 2 below show an example of the speed setting data stored in the storage part 52. Table 1 is an example of the case where the surface tension of the ink [L2] is lower than the surface tension of the cleaning liquid [L1]. On the other hand, Table 2 is an example of the case where the surface tension of the ink [L2] is higher than the surface tension of the cleaning liquid [L1].

TABLE 1

SURFACE TENSION CLEANING LIQUID [L1]: 40 mN/m INK [L2]: 30 mN/m

| | | | | | | | | | | | | | |
|---|---|---|---|---|---|---|---|---|---|---|---|---|---|
| NUMBER OF CLEANING [n] | PIECE | 0 | 10 | 20 | 30 | 40 | 50 | 60 | 70 | 80 | 90 | 100 | 110 |
| INK DENSITY [C] OF CLEANING LIQUID [L] IN STORAGE TANK | % | 0 | 2 | 4 | 6 | 8 | 10 | 12 | 14 | 16 | 18 | 20 | 22 |
| SURFACE TENSION [F] OF CLEANING LIQUID [L] IN STORAGE TANK | mN/m | 40 | 39.8 | 39.6 | 39.4 | 39.2 | 39 | 38.8 | 38.6 | 38.4 | 38.2 | 38 | 37.8 |
| MOVING SPEED [vx] | mm/sec | 50 | 47 | 44 | 41 | 38 | 35 | 32 | 29 | 26 | 23 | 20 | 17 |
| ROTATION SPEED [vr] | mm/sec | 100 | 110 | 120 | 130 | 140 | 150 | 160 | 170 | 180 | 190 | 200 | 210 |
| SPEED RATIO [vr/vx] | — | 2.00 | 2.34 | 2.73 | 3.17 | 3.68 | 4.29 | 5.00 | 5.86 | 6.92 | 8.26 | 10.00 | 12.35 |

TABLE 2

SURFACE TENSION CLEANING LIQUID [L1]: 40 mN/m INK [L2]: 50 mN/m

| | | | | | | | | | | | | | | |
|---|---|---|---|---|---|---|---|---|---|---|---|---|---|---|
| NUMBER OF CLEANING [n] | PIECE | 0 | 10 | 20 | 30 | 40 | 50 | 60 | 70 | 80 | 90 | 100 | 110 | 120 |
| INK DENSITY [C] OF CLEANING LIQUID [L] IN STORAGE TANK | % | 0 | 2 | 4 | 6 | 8 | 10 | 12 | 14 | 16 | 18 | 20 | 22 | 24 |
| SURFACE TENSION [F] OF CLEANING LIQUID [L] IN STORAGE TANK | mN/m | 40 | 40.2 | 40.4 | 40.6 | 40.8 | 41 | 41.2 | 41.4 | 41.6 | 41.8 | 42 | 42.2 | 42.4 |
| MOVING SPEED [vx] | mm/sec | 50 | 53 | 56 | 59 | 62 | 65 | 68 | 71 | 74 | 77 | 80 | 83 | 86 |
| ROTATION SPEED [vr] | mm/sec | 100 | 95 | 90 | 85 | 80 | 75 | 70 | 65 | 60 | 55 | 50 | 45 | 40 |
| SPEED RATIO [vr/vx] | — | 2.00 | 1.79 | 1.61 | 1.44 | 1.29 | 1.15 | 1.03 | 0.92 | 0.81 | 0.71 | 0.63 | 0.54 | 0.47 |

In the speed setting data shown in Tables 1 and 2, the number of cleaning [n] is the number of ink heads 22B subjected to pressure purge among the ink heads 22 wiped by the cleaning roller 41, and is an integrated value. The number of cleaning [n] is one of data representing a change in the composition of the cleaning liquid [L] in the storage tank 44. That is, in the ink head 22B subjected to the pressure purge, the ink [L2] is forcibly pushed out from each nozzle opening 22*a*. The pushed out ink [L2] is brought into the storage tank 44 from the cleaning roller 41, and the density of the ink [L2] in the cleaning liquid [L] is increased.

As shown in Tables 1 and 2, the moving speed [vx] of the cleaning unit 40 and the rotation speed [vr] of the cleaning roller 41 are stored in the storage part 52 as data corresponding to the number of cleaning [n] as described above.

In the storage part 52, the ink density [C] of the cleaning liquid [L] in the storage tank and the surface tension [F] of the cleaning liquid [L] in the storage tank may be stored as values corresponding to the number of cleaning [n]. Among these, the ink density [C] and the surface tension [F] are also one of pieces of data representing a change in the composition of the cleaning liquid [L] in the storage tank 44.

Here, as shown in Table 1, when the surface tension of the ink [L2] is lower than the surface tension of the initial cleaning liquid [L1], as the ink [L2] in the cleaning liquid [L] increases along with the increase of the number of cleaning [n], the surface tension of the cleaning liquid [L] decreases. In this case, the moving speed [vx] is decreased according to the reduction of the surface tension due to the composition change of the cleaning liquid [L], and the rotation speed [vr] is increased. Then, the speed ratio [vr/vx] of the rotation speed [vr] to the moving speed [vx] is increased. This is because, when the ink density [L2] of the cleaning liquid [L] increases and the surface tension decreases, the cleaning liquid [L] easily remains on the water-repellent nozzle surface 20*a*, and this is for preventing such remaining of the cleaning liquid [L].

That is, by decreasing the moving speed [vx] of the cleaning roller 41 relative to the nozzle surface 20*a*, the number of hole portions 401 of the cleaning roller 41 supplied per unit time to the nozzle surface 20*a* per unit area can be increased. As a result, the absorption power of the cleaning liquid [L] by the cleaning roller 41 can be increased.

Also by increasing the rotation speed [vr] of the cleaning roller 41, the number of hole portions 401 of the cleaning roller 41 supplied per unit time to the nozzle surface 20*a* per unit area can be increased. As a result, the absorption power of the cleaning liquid [L] by the cleaning roller 41 can be increased.

Therefore, by increasing the speed ratio [vr/vx] of the rotation speed [vr] to the moving speed [vx], the remaining [L'] of the cleaning liquid [L] whose surface tension has been reduced to the nozzle surface 20*a* can be prevented.

In the initial stage where the number of cleaning [n] is small, the moving speed [vx] is high, so that the sliding amount (sliding time and sliding area) of the cleaning roller 41 on the nozzle surface 20*a* can be suppressed. Also by the fact that the rotation speed [vr] of the cleaning roller 41 is small, the sliding amount (sliding time and sliding area) of the cleaning roller 41 on the nozzle surface 20*a* can be suppressed. Therefore, at the initial stage where the number of cleaning [n] is small, the speed ratio [vr/vx] is lowered to suppress the sliding amount (sliding time and sliding area) of the cleaning roller 41 on the nozzle surface 20*a* so that it is possible to prevent the water repellency of the nozzle surface 20*a* from being reduced and the wiping member 41*b* of the cleaning roller 41 from being deteriorated.

On the other hand, as shown in Table 2, when the surface tension of the ink [L2] is higher than the surface tension of the initial cleaning liquid [L1], as the ink [L2] in the cleaning liquid [L] increases along with the increase of the number of cleaning [n], the surface tension of the cleaning liquid [L] increases. In this case, the moving speed [vx] is increased according to the increase of the surface tension due to the composition change of the cleaning liquid [L], and the rotation speed [vr] is decreased. Then, the speed ratio [vr/vx] of the rotation speed [vr] to the moving speed [vx] is decreased. This is because, when the ink density [L2] of the cleaning liquid [L] is increased and the surface tension is increased, the wettability of the cleaning liquid [L] to the water-repellent nozzle surface 20*a* is further reduced, and this is for preventing the deterioration due to sliding of the cleaning roller 41 with respect to the nozzle surface 20*a* more than necessary.

That is, by relatively increasing the moving speed [vx] of the cleaning roller 41 with respect to the nozzle surface 20*a*, the sliding amount (sliding time and sliding area) of the cleaning roller 41 to the nozzle surface 20*a* can be suppressed. As a result, it is possible to prevent reduction of the water repellency of the nozzle surface 20*a* and degradation of the wiping member 41*b* of the cleaning roller 41.

Also by decreasing the rotation speed [vr] of the cleaning roller 41, the sliding amount (sliding time and sliding area) of the cleaning roller 41 on the nozzle surface 20*a* can be suppressed. As a result, it is possible to prevent reduction of the water repellency of the nozzle surface 20*a* and degradation of the wiping member 41*b* of the cleaning roller 41.

Therefore, by reducing the speed ratio [vr/vx] of the rotation speed [vr] to the moving speed [vx], while the wiping performance of the cleaning liquid [L] from the water-repellent nozzle surface 20*a* by the cleaning roller 41 is maintained, the deterioration of the nozzle surface 20*a* and the cleaning roller 41 can be suppressed. The example shown in Table 2 is an example, and if the decrease of the speed ratio [vr/vx] along with the increase of the number of cleaning [n] is maintained, each of the moving speed [vx] and the rotation speed [vr] may have different values from each other.

It is assumed that the speed setting data as described above is a value derived from the result of a simulation or cleaning test performed in advance.

[Integration Processing Part 53]

The integration processing part 53 performs integration processing of the number of cleaning [n] for each cleaning roller 41. The integration processing part 53 performs the integration processing on the basis of the history of the head cleaning processing stored in the storage part 52 and the information from the ink head control part 21 provided in each head unit 20. Here, as described above, among the ink heads 22 wiped by the cleaning roller 41, the number of ink heads 22B subjected to pressure purge by the ink supply device 1*b* is integrated for each cleaning roller 41. The integration processing part 53 holds the integrated number of cleaning [n]. The integration processing part 53 as described above is a composition acquisition part that acquires a change in the composition of the cleaning liquid [L] in the storage tank 44 due to the mixing of the ink [L2] supplied from the nozzle surface 20*a* via the cleaning roller 41.

(Head Cleaning Method of Image Forming Device)

Figure 10:
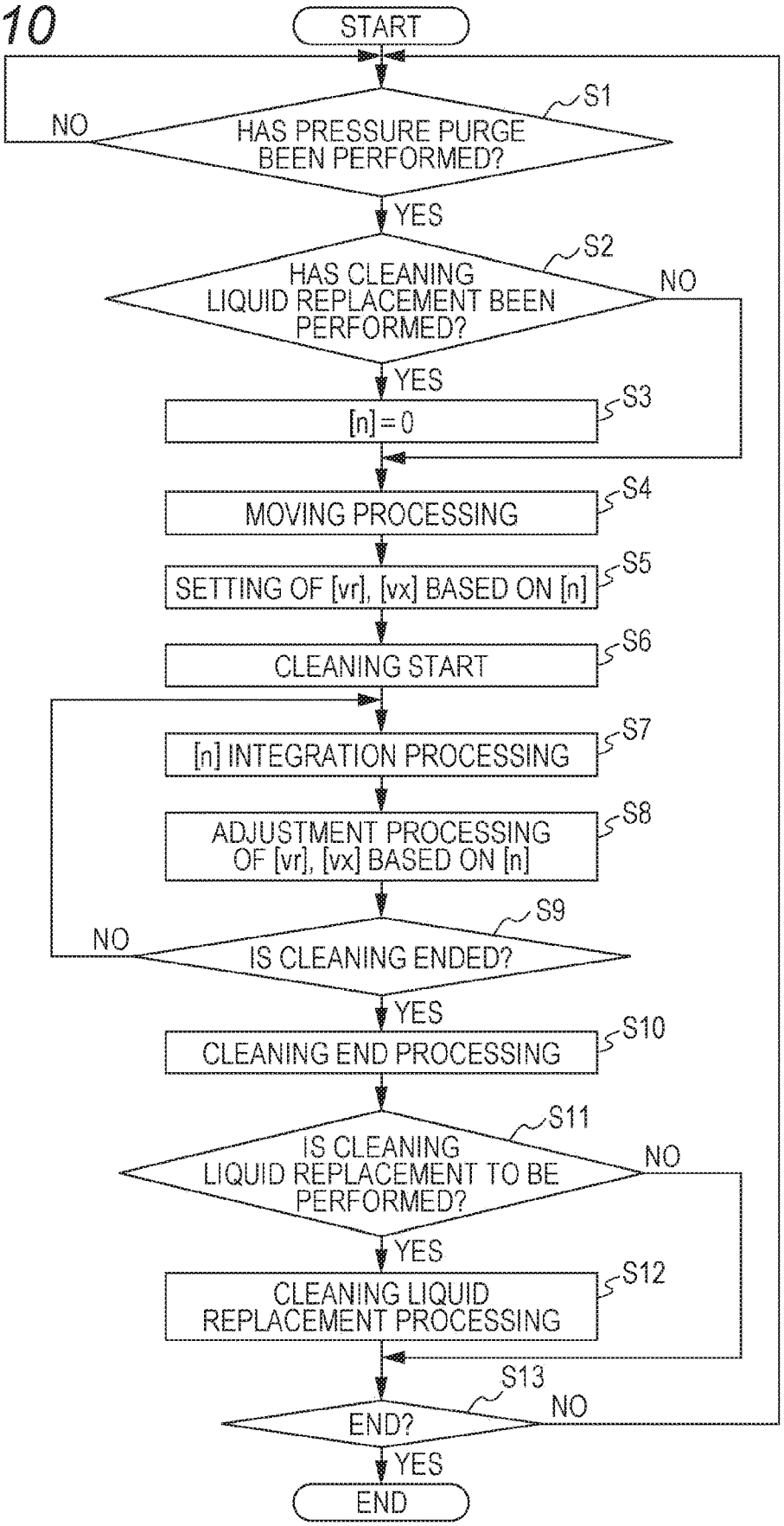
FIG. 10 is a flowchart showing the procedure of the cleaning of the nozzle surface by the head cleaning device according to the first embodiment.

FIG. 10 is a flowchart showing the procedure of the cleaning of the nozzle surface 20*a* by the head cleaning device 1*c* according to the first embodiment. The head cleaning method shown in this flowchart is realized by causing the cleaning control part 50 to execute the image forming program stored in the ROM or RAM by the CPU constituting the cleaning control part 50 described with reference to FIG. 9. The head cleaning method of the image forming device performed by the cleaning control part 50 will be described below with reference to FIGS. 5 and 9 and, if necessary, other drawings in the order shown in the flowchart of FIG. 10.

<Step S1>

In step S1, the input and output control part 51 determines whether the pressure purge has been performed. At this time, the input and output control part 51 determines whether the pressure purge of forcibly pushing out the ink [L2] in the nozzle is performed in the head unit 20 of the ink supply device 1*b* on the basis of the information from the ink head control part 21 of the ink supply device 1*b*. The process is repeated until it is determined that the processing has been performed (YES), and when it is determined that the processing has been performed (YES), the process proceeds to step S2.

<Step S2>

In step S2, the input and output control part 51 determines whether the replacement processing of the cleaning liquid [L] has been performed. At this time, the input and output control part 51 determines whether the replacement processing of the cleaning liquid [L] in the storage tank 44 has been performed after the previous cleaning processing on the basis of the head cleaning history stored in the storage part 52. When it is determined that the processing has been performed (YES), the process proceeds to step S3. On the other hand, when it is determined that the processing has not been performed (NO), the process proceeds to step S4. Note that this determination is performed for each cleaning unit 40, or in the case where replacement processing of cleaning liquid [L] is performed simultaneously for all the cleaning units 40, the determination is performed commonly for all the cleaning units 40.

<Step S3>

In step S3, the input and output control part 51 initializes all the numbers of cleaning [n] held in the integration processing part 53 to [n]=0. When the determination in step S2 is performed for each cleaning unit 40, only the number of cleaning [n] corresponding to the cleaning unit 40 determined as performed in step S2 (YES) is initialized to [n]=0

<Step S4>

In step S4, the input and output control part 51 performs moving processing of the head unit 20 and the cleaning unit 40. At this time, the input and output control part 51 first controls the height adjustment mechanism 26 of the ink supply device 1*b* to move each head unit 20 of the ink supply device 1*b* to the height at the time of head cleaning (see FIG. 2). Next, the input and output control part 51 controls the unit moving mechanism 47 to move each cleaning unit 40 to an interval [d] between the nozzle surface 20*a* of each head unit 20 and the mounting surface 13*s* of the endless belt 13 to a predetermined state. At this time, the unit moving mechanism 47 brings the cleaning roller 41 into contact with the edge of the nozzle surface 20*a*.

<Step S5>

In step S5, the input and output control part 51 sets the cleaning speed. The cleaning speed set here is the moving speed [vx] of each cleaning unit 40 and the rotation speed [vr] of each cleaning roller 41. The input and output control part 51 sets the cleaning speed on the basis of the number of cleaning [n] held in the integration processing part 53 and the speed setting data stored in the storage part 52.

At this time, the input and output control part 51 extracts the moving speed [vx] of each cleaning unit 40 stored in the storage part 52 and the rotation speed [vr] of each cleaning roller 41 correspondingly to the number of cleaning [n] held in the integration processing part 53 for each cleaning unit 40. The extracted value is set as the moving speed [vx] of each cleaning unit 40 and the rotation speed [vr] of each cleaning roller 41.

For example, at the initial stage of cleaning, the speed setting part 54 refers to Tables 1 and 2 and sets the moving speed [vx] (=50 mm/sec) and the rotation speed [vr] (=100 mm/sec) extracted correspondingly to the number of cleaning [n]=0, as the moving speed [vx] of each cleaning unit 40 and the rotation speed [vr] of each cleaning roller 41.

<Step S6>

In step S6, the input and output control part 51 starts the cleaning processing. At this time, the input and output control part 51 controls the roller drive part 42 to rotate each cleaning roller 41 at the rotation speed [vr] set in step S5. The input and output control part 51 controls the unit moving mechanism 47 to move each cleaning unit 40 at the moving speed [vx] set in step S5. As a result, the cleaning processing of wiping off the nozzle surface 20*a* of each head unit 20 by the wiping member 41*b* of each cleaning roller 41 is started.

<Step S7>

In step S7, the input and output control part 51 causes the integration processing part 53 to perform integration processing of the number of cleaning [n]. At this time, the integration processing part 53 performs processing of integrating the number of ink heads 22B subjected to pressure purge among the ink heads 22 of the head unit 20 performing the cleaning on the basis of the information from the ink head control part 21 provided in each head unit 20, and the moving speed [vx] of each cleaning unit 40 set in step S5 as needed. The integration processing part 53 holds the integrated number of cleaning [n].

<Step S8>

In step S8, the input and output control part 51 adjusts the cleaning speed. At this time, first, the input and output control part 51 extracts the moving speed [vx] of each cleaning unit 40 stored in the storage part 52 and the rotation speed [vr] of each cleaning roller 41 correspondingly to the number of cleaning [n] held in the integration processing part 53. Next, the input and output control part 51 controls the roller drive part 42 so that the rotation speed [vr] of each cleaning roller 41 is the extracted rotation speed [vr]. The input and output control part 51 controls the unit moving mechanism 47 so that the moving speed [vx] of each cleaning unit 40 is the extracted moving speed [vx].

<Step S9>

In step S9, the input and output control part 51 determines whether the cleaning processing is completed. At this time, when each cleaning unit 40 moves in a predetermined direction and reaches the opposite edge of the nozzle surface 20*a*, the input and output control part 51 determines that the cleaning processing is completed (YES), and the process proceeds to step S10. Steps S7 and S8 are repeated until it is determined that the cleaning processing is completed (YES).

<Step S10>

In step S10, the input and output control part 51 performs cleaning end processing. At this time, the input and output control part 51 first stops the rotation of each cleaning roller 41 and the movement of each cleaning unit 40. Next, the input and output control part 51 controls the unit moving mechanism 47 to move each cleaning unit 40 to the retracted position at the time of image formation (see FIG. 1). Next, the input and output control part 51 controls the height adjustment mechanism 26 of the ink supply device 1*b* to move each head unit 20 of the ink supply device 1*b* to the height at the time of image formation (see FIG. 1).

<Step S11>

In step S11, the input and output control part 51 determines whether replacement of the cleaning liquid [L] is to be performed. At this time, the input and output control part 51 determines whether the cleaning liquid [L] in the storage tank 44 is to be replaced on the basis of the number of cleaning [n] stored in the integration processing part 53 and the speed setting data. For example, when the number of cleaning [n] stored in the integration processing part 53 is equal to or more than the preset number of cleaning [n], the input and output control part 51 determines that the cleaning liquid [L] in the storage tank 44 is to be replaced, and the process proceeds to step S12, and in other cases, the process proceeds to step S13.

For example, referring to Table 1, when the surface tension of the cleaning liquid [L] used in each cleaning unit 40 is 40 mN/m and the surface tension of the ink [L2] used in the corresponding head unit 20 is 30 mN/m, if the number of cleaning [n] stored in the integration processing part 53 is 110 or more, the input and output control part 51 determines that the cleaning liquid is to be replaced (YES). In this case, if the number of cleaning [n] stored in the integration processing part 53 is smaller than 110, the input and output control part 51 determines that the cleaning liquid is not to be replaced (NO).

Referring to Table 2, when the surface tension of the cleaning liquid [L] used in each cleaning unit 40 is 40 mN/m and the surface tension of the ink [L2] used in the corresponding head unit 20 is 50 mN/m, if the number of cleaning [n] stored in the integration processing part 53 is 120 or more, the input and output control part 51 determines that the cleaning liquid is to be replaced (YES). In this case, if the number of cleaning [n] stored in the integration processing part 53 is smaller than 120, the input and output control part 51 determines that the cleaning liquid is not to be replaced (NO).

<Step S12>

In step S12, the input and output control part 51 performs the cleaning liquid replacement processing. At this time, the input and output control part 51 first controls the on-off valve 46*a* provided in the drain pipe 46 of the storage tank 44 to discharge the cleaning liquid [L] from the storage tank 44. Next, the input and output control part 51 controls the on-off valve 45*a* provided in the supply pipe 45 of the storage tank 44 to supply the cleaning liquid [L1] in the initial state to the storage tank 44. As a result, the cleaning liquid [L1] in the initial state, which does not contain the ink [L2] as the cleaning liquid [L], is stored in the storage tank 44.

The input and output control part 51 strengthens the pressing force of the throttle member 43 against the cleaning roller 41 before closing the on-off valve 46*a* of the drain pipe 46 as compared to that at the time of cleaning, and the cleaning liquid [L] containing the ink [L2] impregnated in the cleaning roller 41 is squeezed out from the cleaning roller 41. This prevents the ink [L2] from being carried from the cleaning roller 41 into the cleaning liquid [L] after the cleaning liquid replacement.

<Step S13>

In step S13, the input and output control part 51 determines whether the series of processing is to be ended. In this case, when the power of the image forming device 1 is shut off, for example, the input and output control part 51 determines that the processing is to be ended (YES) and ends the series of processing. On the other hand, if the input and output control part 51 determines that the processing is not to be ended (NO), the process returns to step S1 and waits until the next pressurized purge is performed, and the subsequent steps are repeated.

Effect of First Embodiment

According to the first embodiment described above, the speed ratio [vr/vx] between the moving speed [vx] of the cleaning unit 40 and the rotation speed [vr] of each cleaning roller 41 is controlled on the basis of the number of cleaning [n] of the ink head 22B on which the pressure purge has been performed, which represents the change in the composition of the cleaning liquid [L] in the storage tank 44. As a result, even when the ink density [L2] of the cleaning liquid [L] in the storage tank 44 is increased and the surface tension is decreased, remaining of the cleaning liquid [L] on the nozzle surface 20*a* can be prevented by increasing the speed ratio [vr/vx]. In this case, deterioration of the nozzle surface 20*a* and the cleaning roller 41 can be prevented by keeping the speed ratio [vr/vx] low at the initial stage where the number of cleaning [n] is small.

As a result, regardless of the change in the composition of the cleaning liquid [L] in the storage tank 44, the wiping performance of the nozzle surface 20*a* by the porous cleaning roller 41 that impregnates the cleaning liquid [L] can be stably maintained over a long period of time.

Second Embodiment

Figure 11:
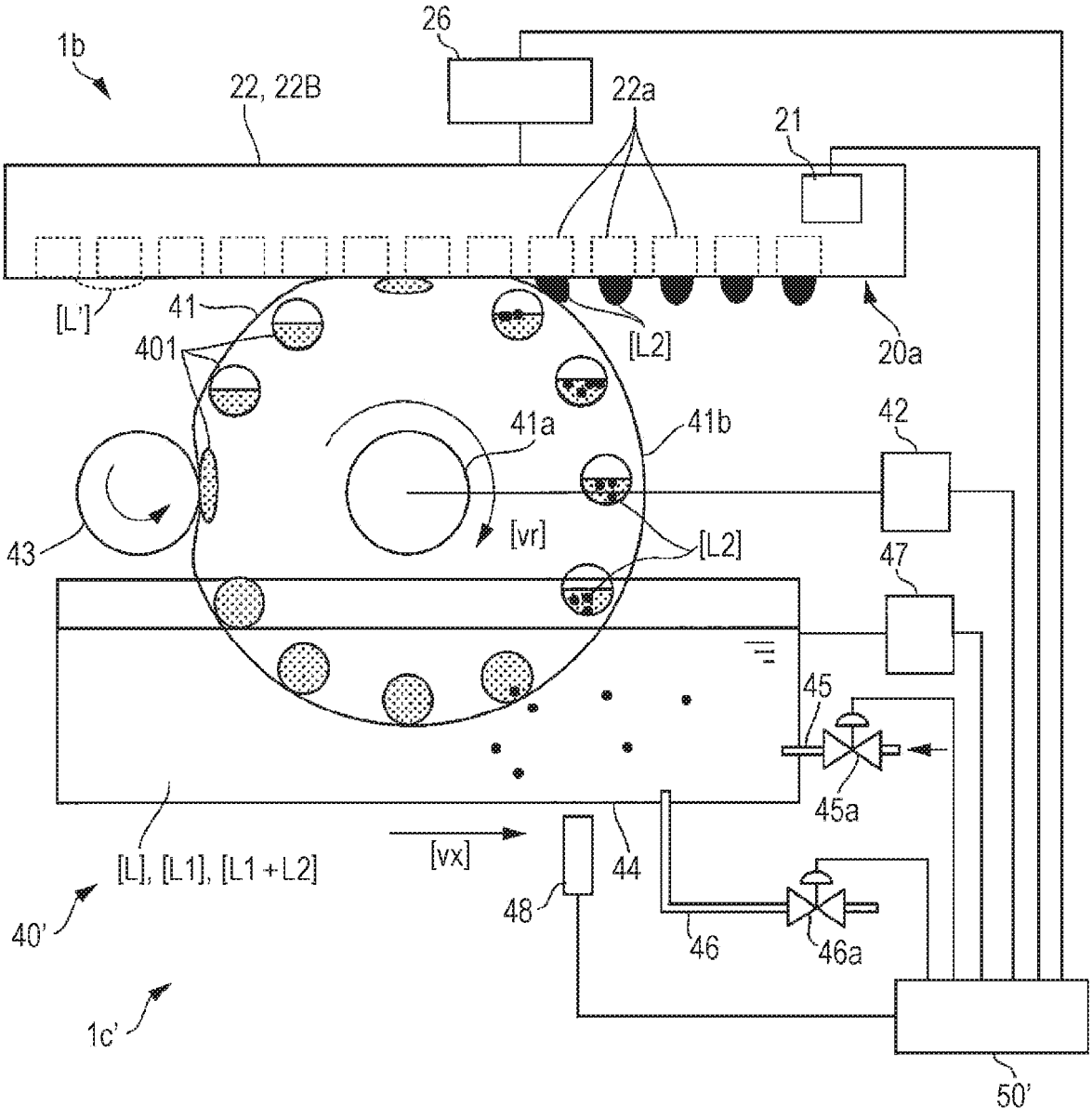
FIG. 11 is a configuration diagram of a head cleaning device according to a second embodiment.

FIG. 11 is a configuration diagram of a head cleaning device 1*c*' according to a second embodiment. The head cleaning device 1*c*' of the second embodiment shown in this drawing is a modification of the head cleaning device 1*c* of the first embodiment, and has a configuration in which an ink density detection part 48 is added to a cleaning unit 40'. Therefore, a part of the configuration of a cleaning control part 50' has a different configuration from the configuration in the first embodiment. Accordingly, the configurations of the ink density detection part 48 and the cleaning control part 50' will be described here, and redundant description of the same components as those of the first embodiment will be omitted.

<Head Cleaning Device 1*c*'>

Cleaning Unit 40'

[Ink Density Detection Part 48]

The ink density detection part 48 is a detector for detecting the ink density [C] of the cleaning liquid [L] stored in the storage tank 44. The configuration of the ink density detection part 48 as described above is not limited as long as it is a device that can detect the density [C] of the ink [L], and for example, a device that detects the ink density [C] by an optical means is used as the ink density detection part 48. The ink density detection part 48 as described above is a composition acquisition part that acquires a change in the composition of the cleaning liquid [L] in the storage tank 44 due to the mixing of the ink [L2] supplied from the nozzle surface 20*a* via the cleaning roller 41.

—Cleaning Control Part 50'—

Figure 12:
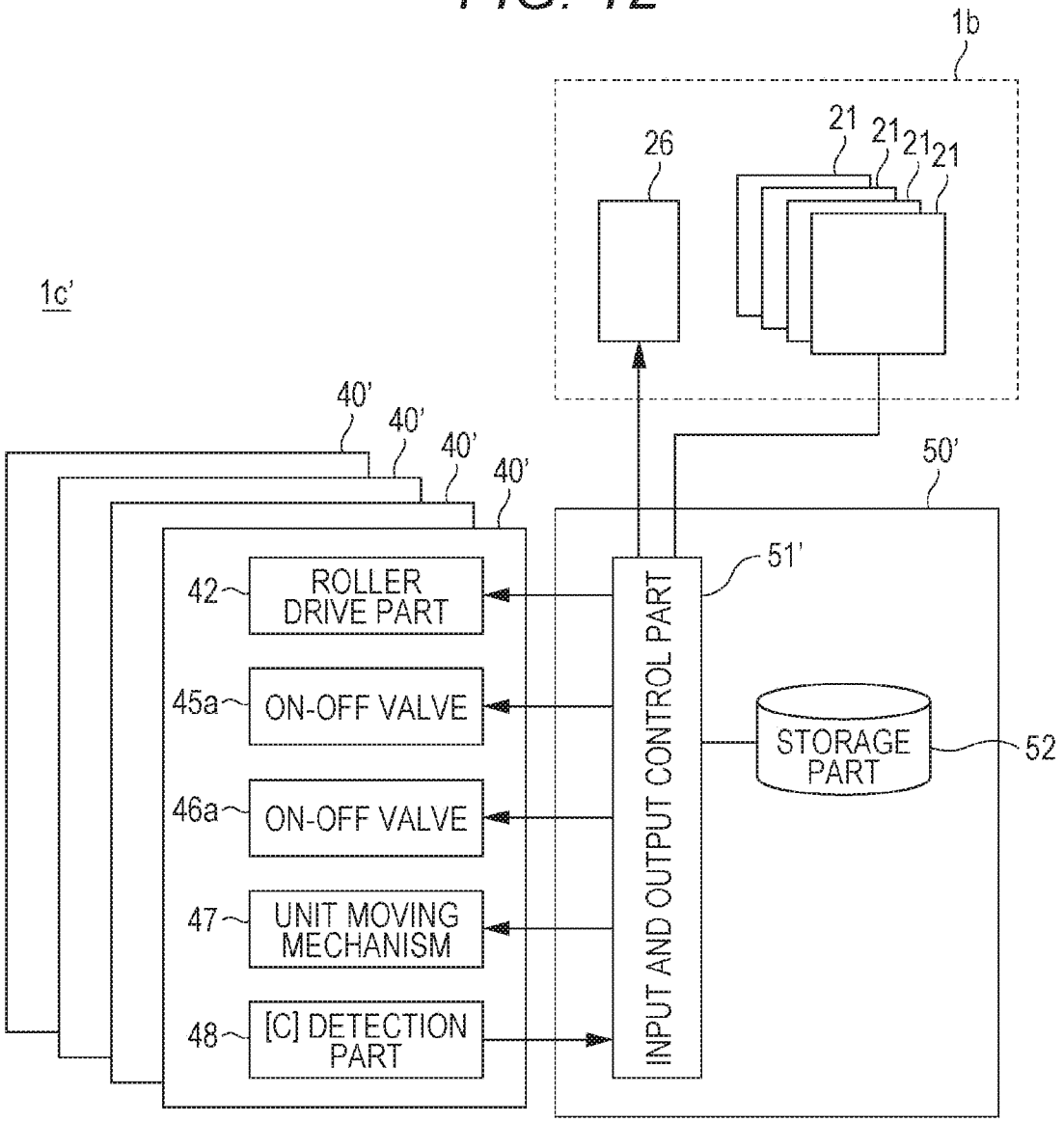
FIG. 12 is a block diagram of the head cleaning device according to the second embodiment.

FIG. 12 is a block diagram of the head cleaning device 1*c*' according to the second embodiment, and mainly shows the configuration of the cleaning control part 50'. The cleaning control part 50' controls the operation of each part of the cleaning unit 40', and is formed by a computer such as a microcomputer. The computer includes a central processing unit (CPU), a read only memory (ROM), and a random access memory (RAM).

The cleaning control part 50' as described above includes an input and output control part 51' and the storage part 52.

Each of these parts has a function to be described next, and the CPU in the cleaning control part 50' reads out and executes a program stored in the ROM to realize each function. Hereinafter, the details of each part constituting the cleaning control part 50' will be described on the basis of FIG. 11 and FIG. 12 described above.

[Input and Output Control Part 51']

The input and output control part 51' is connected to the roller drive part 42, the on-off valves 45*a*, 46*a*, the unit moving mechanism 47, and the ink density detection part 48 of each cleaning unit 40', and further connected to the storage part 52. The input and output control part 51' is connected to the ink head control part 21 and the height adjustment mechanism 26 of the ink supply device 1*b*.

The input and output control part 51' as described above performs input and output processing of data between the respective parts connected to each other via the input and output control part 51', performs determination processing, and controls the drive of the roller drive part 42, the on-off valves 45*a*, 46*a*, and the unit moving mechanism 47 and the height adjustment mechanism 26 of the ink supply device 1*b*. As a result, the cleaning processing of the nozzle surface 20*a* by the cleaning unit 40' is performed. The cleaning processing of the nozzle surface 20*a* performed by the input and output control part 51' will be described in detail in the head cleaning method below.

[Storage Part 52]

As similar to the first embodiment, the storage part 52 stores the history of the head cleaning processing and the speed setting data as various pieces of data for performing the head cleaning method by the head cleaning device 1*c*'. Among the pieces of data, the speed setting data is different from that of the first embodiment.

It is essential that the storage part 52 stores the moving speed [vx] of the cleaning unit 40' and the rotation speed [vr] of the cleaning roller 41 as speed setting data correspondingly to the ink density [C] in the cleaning liquid [L] in the storage tank 44 (see Tables 1 and 2). The ink density [C] in the cleaning liquid [L] in the storage tank 44 is data representing a change in the composition of the cleaning liquid [L] in the storage tank 44. Such speed setting data is unique data for each combination of the cleaning liquid [L1] and the ink [L2] in the initial state, and is stored in the storage part 52 for each combination of the cleaning liquid [L1] and the ink [L2].

The storage part 52 may or may not store the number of cleaning [n] as data representing a change in the composition of the cleaning liquid [L] in the storage tank 44.

(Head Cleaning Method of Image Forming Device)

Figure 13:
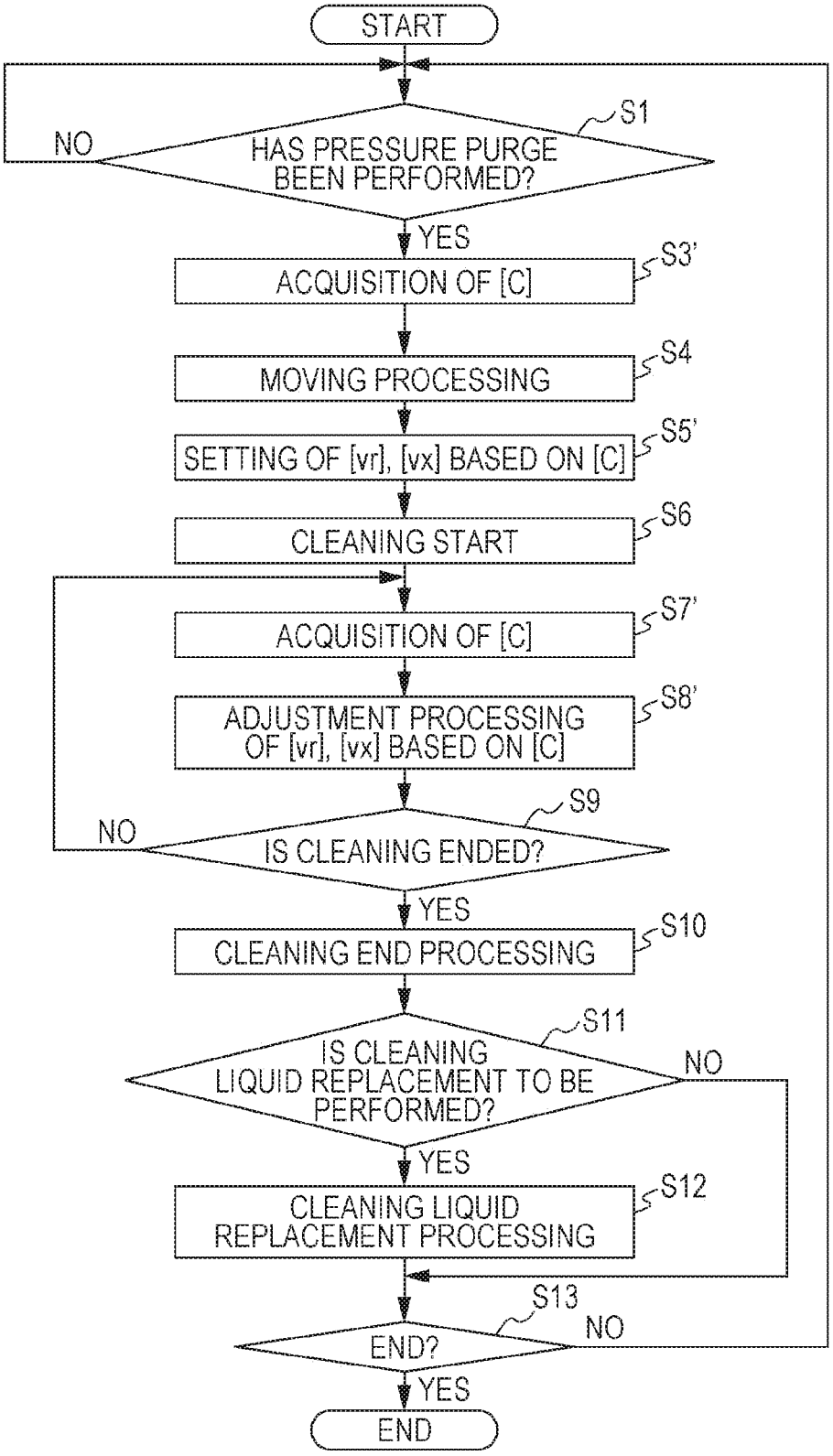
FIG. 13 is a flowchart showing the procedure of the cleaning of the nozzle surface by the head cleaning device according to the second embodiment.

FIG. 13 is a flowchart showing the procedure of the cleaning of the nozzle surface 20*a* by the head cleaning device 1*c*' according to the second embodiment. The head cleaning method according to the second embodiment shown in this flowchart is a modification of the head cleaning method according to the first embodiment, and the similar steps to those in the first embodiment are denoted by the same step numbers, and redundant description will be omitted.

<Step S1>

In step S1, the input and output control part 51' determines whether the pressure purge has been performed, the process is repeated until it is determined that the pressure purge has been performed (YES), and when it is determined that the pressure purge has been performed (YES), the process proceeds to step S3'.

<Step S3'>

In step S3', the input and output control part 51' acquires the ink density [C] of the cleaning liquid [L] in the storage tank 44 from the ink density detection part 48.

<Step S4>

In step S4, the input and output control part 51' performs unit moving processing to move each cleaning unit 40' to between the nozzle surface 20*a* of each head unit 20 and the mounting surface 13*s* of the endless belt 13 to a predetermined state.

<Step S5'>

In step S5', the input and output control part 51' sets the cleaning speed. The cleaning speed set here is the moving speed [vx] of each cleaning unit 40' and the rotation speed [vr] of each cleaning roller 41. The input and output control part 51' sets the cleaning speed on the basis of the acquired ink density [C] and the speed setting data stored in the storage part 52.

At this time, the input and output control part 51' extracts the moving speed [vx] of each cleaning unit 40' stored in the storage part 52 and the rotation speed [vr] of each cleaning roller 41 correspondingly to the acquired ink density [C] for each cleaning unit 40'. The extracted value is set as the moving speed [vx] of each cleaning unit 40' and the rotation speed [vr] of each cleaning roller 41.

For example, at the initial stage of cleaning, the speed setting part 54 refers to Tables 1 and 2 and sets the moving speed [vx] (=50 mm/sec) and the rotation speed [vr] (=100 mm/sec) extracted correspondingly to the acquired ink density [C]=0, as the moving speed [vx] of each cleaning unit 40' and the rotation speed [vr] of each cleaning roller 41.

<Step S6>

In step S6, the input and output control part 51' starts the cleaning processing. At this time, the input and output control part 51' controls the roller drive part 42 to rotate each cleaning roller 41 at the rotation speed [vr] set in step S5'. The input and output control part 51' controls the unit moving mechanism 47 to move each cleaning unit 40' at the moving speed [vx] set in step S5'. As a result, the cleaning of wiping off the nozzle surface 20*a* of each head unit 20 by the wiping member 41*b* of each cleaning roller 41 is started.

<Step S7'>

In step S7', the input and output control part 51' acquires the ink density [C] of the cleaning liquid [L] in the storage tank 44 from the ink density detection part 48.

<Step S8'>

In step S8', the input and output control part 51' adjusts the cleaning speed. At this time, first, the input and output control part 51' extracts the moving speed [vx] of each cleaning unit 40' stored in the storage part 52 and the rotation speed [vr] of each cleaning roller 41 correspondingly to the ink density [C] acquired in step S7'. Next, the input and output control part 51' controls the roller drive part 42 so that the rotation speed [vr] of each cleaning roller 41 is the extracted rotation speed [vr]. The input and output control part 51' controls the unit moving mechanism 47 so that the moving speed [vx] of each cleaning unit 40' is the extracted moving speed [vx].

<Steps S9 to S13>

The subsequent steps S9 to S13 are performed in a similar manner to the steps of the first embodiment.

Effect of Second Embodiment

Even in the configuration of the second embodiment as described above, the speed ratio [vr/vx] of the moving speed [vx] of the cleaning unit 40 and the rotation speed [vr] of each cleaning roller 41 are controlled on the basis of the ink density [C] that represents the change in the composition of the cleaning liquid [L] in the storage tank 44, so that, as in the first embodiment, regardless of the change in the composition of the cleaning liquid [L] in the storage tank 44, the wiping performance of the nozzle surface 20*a* by the porous cleaning roller 41 impregnated with the cleaning liquid [L] can be stably maintained over a long period of time.

<<Modification>>

Figure 14:
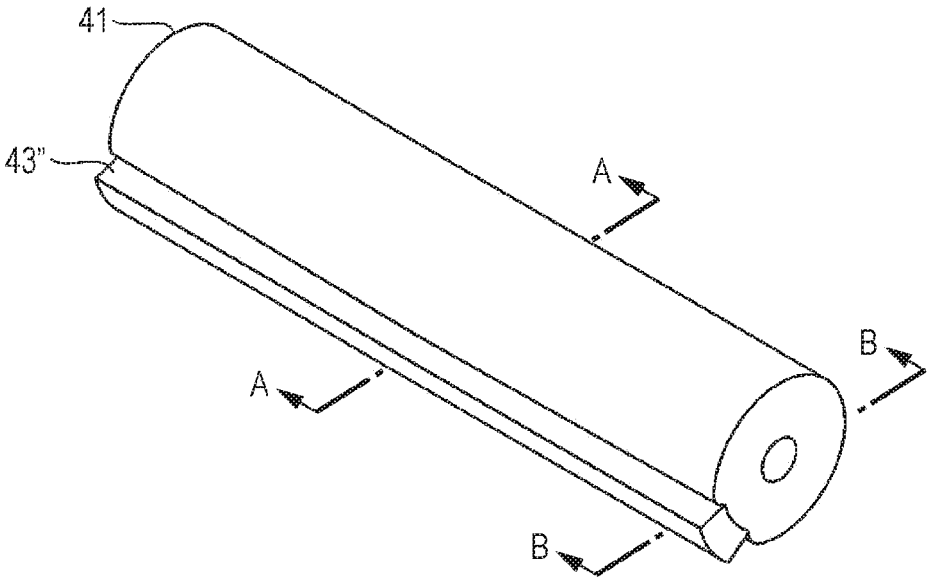
FIG. 14 is a main part perspective view explaining a modification of a head cleaning device according to an embodiment.
Figure 15A:
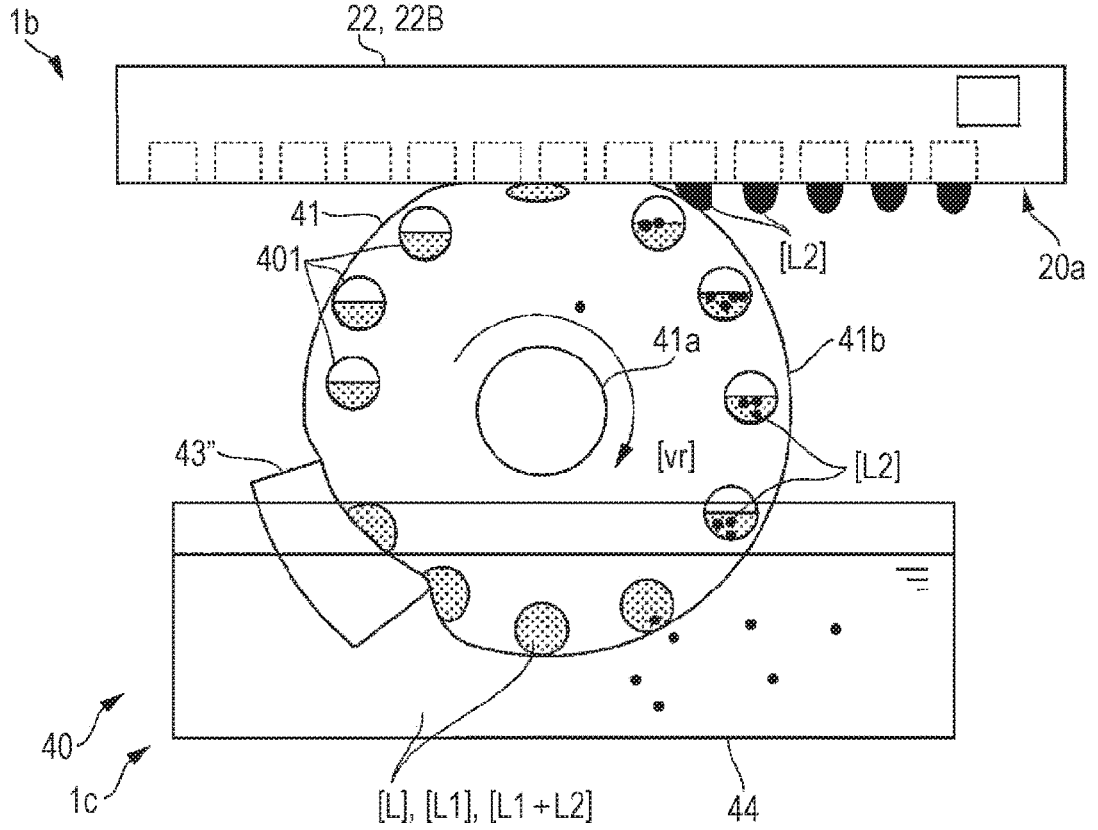
FIGS. 15A and 15B are main part sectional views explaining the modification of the head cleaning device according to an embodiment.
Figure 15B:
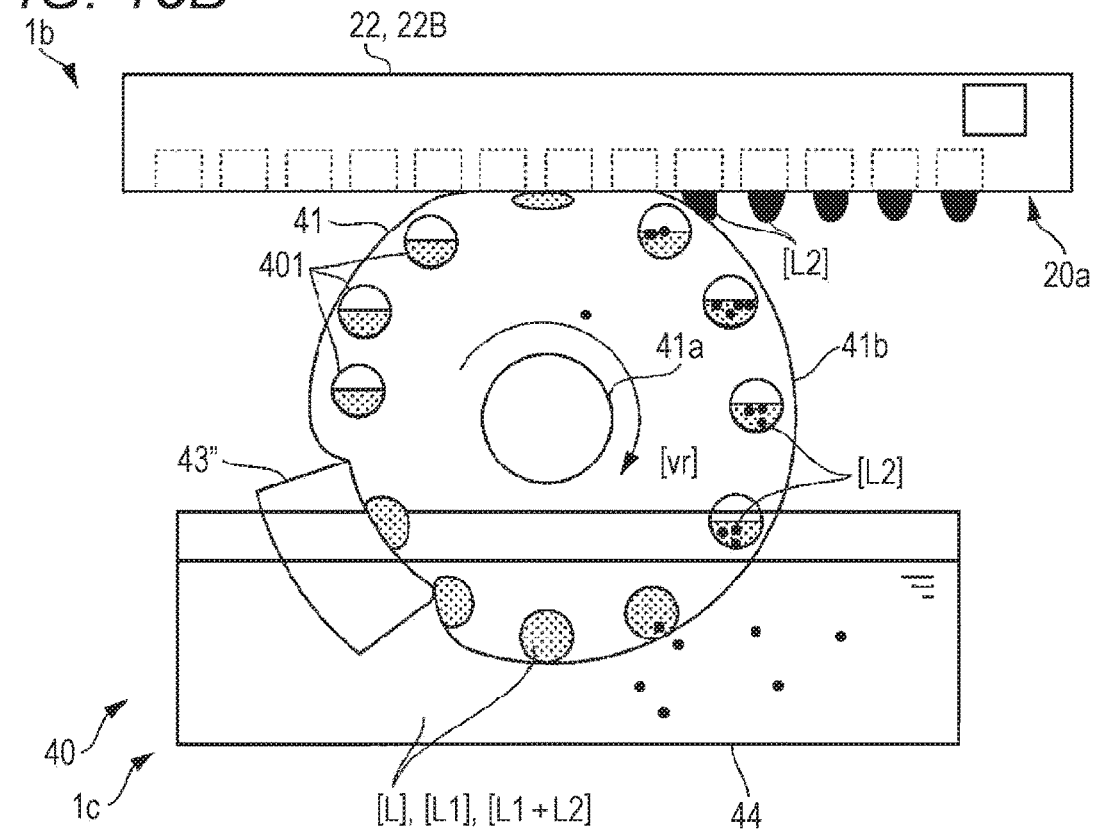

FIG. 14 is a main part perspective view explaining a modification of a head cleaning device according to an embodiment. FIGS. 15A and 15B are main part sectional views explaining the modification of the head cleaning device according to an embodiment. FIG. 15A corresponds to the cross section of the part A in FIG. 14, and FIG. 15B corresponds to the cross section of the part B in FIG. 14. The modification shown in these drawings differs from the head cleaning device of the first embodiment and the second embodiment only in the configuration of the throttle member 43" provided in contact with the cleaning roller 41.

That is, the throttle member 43" is provided in a state of being in pressure contact with the side circumferential surface of the cleaning roller 41 constituted by the wiping member 41*b*, and controls the amount of the cleaning liquid [L] impregnated in the wiping member 41*b*. The throttle member 43" as described above is made of a material harder than the wiping member 41*b*, such as hard rubber or stainless steel.

In particular, the throttle member 43" is formed by a part obtained by dividing a cylindrical member covering the side circumferential surface of the cleaning roller 41 in the axial direction, and is formed as a plate member curved along the circumferential direction of the side circumferential surface of the cleaning roller 41.

The throttle member 43" as described above is supported by a support member (not shown), and can adjust the pressing force on the cleaning roller 41.

The throttle member 43" is provided in pressure contact with the side circumferential surface of the cleaning roller 41 in a range from the lower side of the liquid surface of the cleaning liquid [L] to the upper side of the liquid surface on the upstream side of the position where the cleaning roller 41 is brought into pressure contact with the nozzle surface 20*a* in the rotation direction of the cleaning roller 41.

The contact pressure of the throttle member 43" with respect to the side circumferential surface of the cleaning roller 41 is stronger toward the upstream in the rotation direction of the cleaning roller 41 at the axial center of the cleaning roller 41. On the other hand, at both axial ends of the cleaning roller 41, it is assumed that the contact pressure is set to be high on average from the upstream side to the downstream side in the rotation direction of the cleaning roller 41. The throttle member 43" as described above can be formed such that the contact pressure with respect to each part of the cleaning roller 41 is adjusted by the thickness of the curved plate-like member. That is, in the throttle member 43", the plate thickness of the portion in contact with the lower side of the liquid surface S and the plate thickness of the portion in pressure contact with both axial ends of the cleaning roller 41 are thicker than the other portions, and the throttle member 43" is arranged close to the rotation center of the cleaning roller 41.

(Effect of Modification)

According to such a modification, the throttle member 43" is brought into pressure contact with the cleaning roller 41 from the lower side to the upper side of the liquid surface S of the cleaning liquid [L], so that the cleaning liquid [L] impregnated in the hole portion 401 of the wiping member 41*b* of the cleaning roller 41 can be squeezed out from the hole portion 401 at an earlier stage. As a result, the distance between the nip portion of the nozzle surface 20*a* and the cleaning roller 41, and the throttle member 43" can be increased, and the wiping member 41*b* in a deformed state due to the contact of the throttle member 43" can be fully restored to its original shape until the wiping member 41*b* reaches the nip portion.

Therefore, the throttle member 43" can be brought into contact with the cleaning roller 41 with a further higher pressure to squeeze out the cleaning liquid [L], and the space inside the hole portion 401 reaching the nip portion between the nozzle surface 20*a* and the cleaning roller 41 can be expanded. As a result, it is possible to improve the wiping efficiency of the ink [L2] by the wiping member 41*b* on the nozzle surface 20*a*.

Moreover, the end point of the region where the throttle member 43" contacts with the cleaning roller 41 is set above the liquid surface S of the cleaning liquid [L], and the contact pressure of the throttle member 43" is set to large in the entire region from the lower side to the upper side of the liquid surface S for both axial ends of the cleaning roller 41, so that the cleaning liquid [L] can be prevented from being impregnated again in the region where the cleaning liquid [L] is squeezed out due to the contact of the throttle member 43".

<<Another Modification>>

Another modification can be exemplified for the first embodiment and the second embodiment described above. As an example, in the first embodiment, for example, replacement of the cleaning liquid [L] is automatically replaced as described with reference to FIG. 10, but in step S11, when the input and output control part 51 determines that the replacement of the cleaning liquid [L] is to be performed (YES), notification of a cleaning liquid replacement message may be made. In this case, the notification of the message is performed, for example, to an external device possessed by the maintenance manager of the image forming device 1 or a display part of the image forming device whose description is omitted here.

In the first embodiment, the cleaning roller 41 is moved in a predetermined direction with respect to the nozzle surface 20*a* on which the plurality of ink heads 22 are arranged to perform the cleaning. However, the head cleaning device 1*c* can also be similarly applied to a device having a purpose of cleaning of the nozzle surface 20*a* on which one ink head 22 is arranged. In this case, the number of times the cleaning by the cleaning roller 41 is repeated for one ink head 22 after the pressure purge is performed may be the number of cleaning [n].

Furthermore, in the first and second embodiments, the cleaning roller 41 is moved in the predetermined direction with respect to the nozzle surface 20*a*. However, the movement and moving speed [vx] of the cleaning roller 41 with respect to the nozzle surface 20*a* may be relative, and the head unit 20 having the nozzle surface 20*a* may be moved with respect to the rotated cleaning roller 41, or both of them may be moved.

In addition, in the first and second embodiments, the cleaning unit 40 including the cleaning roller 41 is arranged for each of the plurality of head units 20. However, one cleaning unit 40 may be provided for the plurality of head units 20. Furthermore, the relative movement direction of one cleaning unit 40 with respect to the arrangement direction of the plurality of head units 20 is not limited as long as the cleaning roller 41 can wipe the nozzle surface 20*a*.

Although embodiments of the present invention have been described and illustrated in detail, the disclosed embodiments are made for purposes of illustration and example only and not limitation. The scope of the present invention should be interpreted by terms of the appended claims

What is claimed is:

1. A head cleaning device comprising:

a porous cleaning roller that is arranged with a cylindrical axis kept horizontal, rotates around the axis while a cylindrical side circumferential surface is in pressure contact with a nozzle surface of an ink head to clean the nozzle surface;

a storage tank that is provided to store a cleaning liquid and immerse a lower part of the cleaning roller in the cleaning liquid stored;

a unit moving mechanism that moves a cleaning unit including the storage tank and the cleaning roller in a direction perpendicular to the axis of the cleaning roller;

a hardware processor that controls a rotation speed [vr] of the cleaning roller and a moving speed [vx] of the storage tank and the cleaning unit; and a composition acquisition part that acquires a change in composition of the cleaning liquid in the storage tank due to mixing of ink supplied from the nozzle surface through the cleaning roller, wherein the hardware processor controls a speed ratio [vr/vx] of the rotation speed [vr] to the moving speed [vx] based on a change in the composition of the cleaning liquid acquired by the composition acquisition part.

2. The head cleaning device according to claim 1, wherein the hardware processor controls the rotation speed [vr] of the cleaning roller and the moving speed [vx] of the cleaning unit so that the speed ratio [vr/vx] increases according to decrease in a surface tension of the cleaning liquid due to the change in the composition of the cleaning liquid.

3. The head cleaning device according to claim 1, wherein the hardware processor controls the rotation speed [vr] of the cleaning roller and the moving speed [vx] of the cleaning unit so that the speed ratio [vr/vx] decreases according to increase in a surface tension of the cleaning liquid due to the change in the composition of the cleaning liquid.

4. The head cleaning device according to claim 1, wherein the hardware processor integrates the number of cleaning [n] of the ink head by the cleaning roller as the composition acquisition part, and makes the number of cleaning [n] integrated by the hardware processor correspond to the change in the composition of the cleaning liquid.

5. The head cleaning device according to claim 4, wherein the hardware processor determines that the cleaning liquid in the storage tank is to be replaced when the number of cleaning [n] integrated by the hardware processor reaches a predetermined value.

6. The head cleaning device according to claim 1, wherein the cleaning unit includes an ink density detection part that detects an ink density of the cleaning liquid in the storage tank as the composition acquisition part, and the hardware processor makes the ink density detected by the ink density detection part correspond to the change in the composition of the cleaning liquid.

7. The head cleaning device according to claim 6, wherein the hardware processor determines that the cleaning liquid in the storage tank is to be replaced when the ink density detected by the ink density detection part reaches a predetermined value.

8. The head cleaning device according to claim 1, wherein the cleaning unit includes a throttle member brought into pressure contact with the side circumferential surface of the cleaning roller, and the throttle member is provided in pressure contact with the side circumferential surface of the cleaning roller in a range from a lower part of a liquid surface of the cleaning liquid to an upper part of the liquid surface on an upstream side of a position in which the cleaning roller is brought into pressure contact with the nozzle surface in a rotation direction of the cleaning roller.

9. The head cleaning device according to claim 8, wherein the throttle member is brought into pressure contact with the cleaning roller at a pressure stronger than a pressure on a downstream side at an axial center of the cleaning roller at both axial ends of the cleaning roller and an upstream side of the rotation direction of the cleaning roller.

10. The head cleaning device according to claim 9, wherein the throttle member is a plate-like member curved along an outer circumferential surface of the cleaning roller, and the pressure of the pressure contact is adjusted by a plate thickness.

11. An image forming device comprising: an ink supply device including an ink head; and a head cleaning device that cleans a nozzle surface of the ink head, wherein the head cleaning device includes a porous cleaning roller that is arranged with a cylindrical axis kept horizontal, rotates around the axis while a cylindrical side circumferential surface is in pressure contact with a nozzle surface of an ink head to clean the nozzle surface, a storage tank that is provided to store a cleaning liquid and immerse a lower part of the cleaning roller in the cleaning liquid stored, a unit moving mechanism that moves a cleaning unit including the storage tank and the cleaning roller in a direction perpendicular to the axis of the cleaning roller, a hardware processor that controls a rotation speed [vr] of the cleaning roller and a moving speed [vx] of the cleaning unit, and a composition acquisition part that acquires a change in composition of the cleaning liquid in the storage tank due to mixing of ink supplied from the nozzle surface through the cleaning roller, and the hardware processor controls a speed ratio [vr/vx] of the rotation speed [vr] to the moving speed [vx] based on a change in the composition of the cleaning liquid acquired by the composition acquisition part.

12. A head cleaning method of an image forming device that includes a head cleaning device including a porous cleaning roller that is arranged with a cylindrical axis kept horizontal, rotates around the axis while a cylindrical side circumferential surface is in pressure contact with a nozzle surface of an ink head to clean the nozzle surface, a storage tank that is provided to store a cleaning liquid and immerse a lower part of the cleaning roller in the cleaning liquid stored, a unit moving mechanism that moves a cleaning unit comprising the storage tank and the cleaning roller in a direction perpendicular to the axis of the cleaning roller;

a hardware processor that controls a rotation speed [vr] of the cleaning roller and a moving speed [vx] of the cleaning unit, and a composition acquisition part that acquires a change in composition of the cleaning liquid in the storage tank due to mixing of ink supplied from the nozzle surface through the cleaning roller, the nozzle surface of the ink head being cleaned by the cleaning roller, the head cleaning method comprising:

controlling a speed ratio [vr/vx] of the rotation speed [vr] to the moving speed [vx] by the hardware processor based on a change in the composition of the cleaning liquid acquired by the composition acquisition part.

* * * * *